US005848531A

United States Patent [19]

Nakamura et al.

[11] Patent Number: 5,848,531

[45] Date of Patent: Dec. 15, 1998

[54] HYDRAULIC DRIVE SYSTEM FOR CONSTRUCTION MACHINES

[75] Inventors: Tsuyoshi Nakamura, Ibaraki-ken; Toichi Hirata, Ushiku; Genroku Sugiyama, Ibaraki-ken; Tsukasa Toyooka, Ibaraki-ken; Youichi Kowatari, Ibaraki-ken; Kouji Ishikawa, Tsuchiura, all of Japan

[73] Assignee: Hitachi Construction Machinery Co., Ltd., Tokyo, Japan

[21] Appl. No.: 774,725

[22] Filed: Jan. 3, 1997

[30] Foreign Application Priority Data

Jan. 8, 1996 [JP] Japan ..... 8-000668

[51] Int. Cl.[6] ..... F61D 31/02

[52] U.S. Cl. ..... 60/426; 60/459; 60/494

[58] Field of Search ..... 60/420, 426, 468, 60/494, 459, 422

[56] References Cited

U.S. PATENT DOCUMENTS

| | | | |
|---|---|---|---|
| 5,129,230 | 7/1992 | Izumi et al. | 60/468 X |
| 5,295,353 | 3/1994 | Ikari | 60/468 X |
| 5,394,697 | 3/1995 | Hirata | 60/468 X |
| 5,537,819 | 7/1996 | Kobayashi | 60/468 X |
| 5,680,760 | 10/1997 | Lunzman | 60/468 X |

FOREIGN PATENT DOCUMENTS

| | | |
|---|---|---|
| 597 109 | 5/1994 | European Pat. Off. . |
| 629 781 | 12/1994 | European Pat. Off. . |
| 648 900 | 4/1995 | European Pat. Off. . |
| 4-191502 | 9/1992 | Japan . |
| 7-116731 | 12/1995 | Japan . |

*Primary Examiner*—Hoang Nguyen

*Attorney, Agent, or Firm*—Fay, Sharpe, Beall, Fagan, Minnich & McKee

[57] ABSTRACT

A hydraulic system for a construction machine includes a hydraulic pump driven by a prime mover, actuators driven by a hydraulic fluid delivered from the hydraulic pump, flow control valves for controlling flow of the hydraulic fluid to the actuators and operation means for operating the flow control valves. A relief value sets a relief pressure for limiting the maximum delivery pressure of the hydraulic pump and relief pressure change means increase or decrease the relief pressure set by the relief valve. The relief pressure change means automatically increase or decrease the relief pressure in accordance with the input amount of the operation means.

17 Claims, 25 Drawing Sheets

FIG.6

| | INPUT AMOUNT OF $P_{a0}$ OR MORE OR $P_{b0}$ OR MORE | INPUT AMOUNT OF LESS THAN $P_{a0}$ AND LESS THAN $P_{b0}$ |
|---|---|---|
| ON DRIVING SIGNAL | PRESSURE INCREASE | PRESSURE INCREASE |
| OFF DRIVING SIGNAL | PRESSURE INCREASE | × |

FIG.9

| | INPUT AMOUNT OF $P_{a0}$ OR MORE OR $P_{b0}$ OR MORE | INPUT AMOUNT OF LESS THAN $P_{a0}$ AND LESS THAN $P_{b0}$ |
|---|---|---|
| HEAVY EXCAVATION | PRESSURE INCREASE | × |
| EXCAVATION | × | × |
| FINE OPERATION | × | × |

FIG.12

| | | INPUT AMOUNT OF $P_{a0}$ OR MORE OR $P_{b0}$ OR MORE | INPUT AMOUNT OF LESS THAN $P_{a0}$ AND LESS THAN $P_{b0}$ |
|---|---|---|---|
| HEAVY EXCAVATION | ON DRIVING SIGNAL | PRESSURE INCREASE | PRESSURE INCREASE |
| | OFF DRIVING SIGNAL | PRESSURE INCREASE | × |
| EXCAVATION | ON DRIVING SIGNAL | PRESSURE INCREASE | PRESSURE INCREASE |
| | OFF DRIVING SIGNAL | × | × |
| FINE OPERATION | ON DRIVING SIGNAL | PRESSURE INCREASE | PRESSURE INCREASE |
| | OFF DRIVING SIGNAL | × | × |

FIG.21

| | | INPUT AMOUNT OF $P_{a0}$ OR MORE OR $P_{b0}$ OR MORE | INPUT AMOUNT OF LESS THAN $P_{a0}$ AND LESS THAN $P_{b0}$ |
|---|---|---|---|
| HEAVY EXCAVATION | ON(2) DRIVING SIGNAL | $\Delta P$ PRESSURE INCREASE | $\Delta P$ PRESSURE INCREASE |
| | OFF DRIVING SIGNAL | $\Delta P$ PRESSURE INCREASE | × |
| EXCAVATION | ON(1) DRIVING SIGNAL | $\Delta P_{1/2}$ PRESSURE INCREASE | $\Delta P_{1/2}$ PRESSURE INCREASE |
| | OFF DRIVING SIGNAL | $\Delta P_{1/2}$ PRESSURE INCREASE | × |
| FINE OPERATION | OFF DRIVING SIGNAL | × | × |

HYDRAULIC DRIVE SYSTEM FOR CONSTRUCTION MACHINES

BACKGROUND OF THE INVENTION

The present invention relates to a hydraulic drive system for a construction machine such as a hydraulic excavator, particularly to a hydraulic drive system for a construction machine provided with means for enabling to increase a relief pressure specifying the delivery pressure of a hydraulic pump.

A conventional hydraulic drive system of this type is described below by referring to FIGS. 24 and 25.

FIG. 24 shows a hydraulic circuit diagram of the hydraulic drive system. The hydraulic drive system is provided for a construction machine such as a hydraulic excavator, which comprises a variable displacement hydraulic pump 1 to be driven by a not-illustrated engine, a relief valve 10 for setting a relief pressure to limit the maximum delivery pressure of the hydraulic pump 1 in accordance with the force of a spring 10A, a boom cylinder 2 and an arm cylinder 3 which serve as actuators for respectively driving a boom and an arm of a hydraulic excavator, a center-bypass type boom flow control valve 4 connected between the hydraulic pump 1 and the boom cylinder 2 and controlled by a pilot pressure signal according to the operation of a control-lever system 6 (to be mentioned later) to control the flow rate of the hydraulic fluid supplied from the hydraulic pump 1 to the boom cylinder 2, a center-bypass type arm flow control valve 5 connected between the hydraulic pump 1 and the arm cylinder 3 and controlled by a pilot pressure signal according to the operation of a control-lever system 7 (to be mentioned later) to control the flow rate of the hydraulic fluid supplied from the hydraulic pump 1 to the arm cylinder 3, throttle means 33 provided for the downstream side of the center bypass line of the arm flow control valve 5, a regulator 34 for performing generally-known negative control for the hydraulic pump 1 in accordance with the control pressure produced by the throttle means 33, a control-lever system 6 including a control lever 6A and a pressure reducing valve 6B for reducing the hydraulic pressure supplied from a not-illustrated hydraulic source (e.g. auxiliary hydraulic pump) in accordance with the input amount of the control lever 6A to produce a pilot pressure provided as operation means for operating the flow control valve 4, pilot lines 80*a* and 80*b* for leading the pilot pressure supplied from the control-lever system 6 to the flow control valve 4, a control-lever system 7 including a control lever 7A and a pressure reducing valve 7B for reducing the hydraulic pressure supplied from a not-illustrated hydraulic source (e.g. auxiliary hydraulic pump) in accordance with the input amount of the control lever 7A to produce a pilot pressure provided as operation means for operating the flow control valve 5, pilot lines 90*a* and 90*b* for leading the pilot pressure supplied from the control-lever system 7 to the flow control valve 5, a selecting switch 25 for changing the set pressure of the relief valve 10 by a certain value, a controller 20 for receiving a signal from the selecting switch 25 and outputting a switching signal for a solenoid switching valve 30 (to be mentioned later) in accordance with the receiving signal, and the solenoid switching valve 30 for reducing the control pressure supplied from a hydraulic source (e.g. auxiliary hydraulic pump) in accordance with the switching signal output from the controller 20, and supplying the reduced control pressure to the back-pressure chamber of the relief valve 10 through a line 85, to increase or decrease the relief pressure of the relief valve 10.

Switching of relief pressures by the selecting switch 25 is described below by referring to FIG. 25. FIG. 25 is a chart showing the change of relief pressures when the selecting switch 25 is turned on or off. For instance in the case of setting the relief pressure of the relief valve 10 to $P_0$ by the spring 10A in order to set the maximum delivery pressure of the hydraulic pump 1 to $P_0$, when an operator turns on the selecting switch 25 and an ON signal is input to the controller 20, a switching signal is output to the solenoid switching valve 30 from the controller 20. Thereby, the solenoid switching valve 30 is switched to a connecting position and the hydraulic pressure supplied from the hydraulic source 32 is delivered to the back-pressure chamber of the relief valve 10 and thereby a predetermined pressure $\Delta P$ works on the back-pressure chamber, and the relief pressure is increased by the pressure $\Delta P$ and the force of the spring 10A as shown in FIG. 25 and set to $P_1$.

In this case, the switch 25, controller 20, hydraulic source 32, line 85, and solenoid switching valve 30 constitute a relief pressure change means for increasing or decreasing a relief pressure set by the relief valve 10.

In the above structure, when a light operation requiring no large power such as grading is performed, it is possible to prevent the load applied to the cylinders 2 and 3 from excessively increasing and improve the service life of equipment when the cylinder load pressure rises, that is, when the boom cylinder 2 and the arm cylinder 3 reach their stroke end by keeping the selecting switch 25 turned-off and setting the relief pressure of the relief valve 10 to the normal value $P_0$. Moreover, when a heavy operation requiring a very large power such as load lifting or heavy excavating is performed, the very large power can be obtained when the cylinder load pressure is large by turning on the selecting switch 25 and increasing the relief pressure up to $P_1$.

A known art similar to the above hydraulic drive system is disclosed in JP, B, 7-116731.

SUMMARY OF THE INVENTION

In the case of the above conventional hydraulic drive system, however, an operator must press the selecting switch 25 whenever increasing a relief pressure or returning the pressure to the original value and therefore, there is a problem that the operability is bad. It is an object of the present invention to provide a hydraulic drive system for a construction machine, making it possible to improve the operability for an operator when increasing or decreasing a relief pressure by automatically increasing or decreasing the relief pressure in accordance with the operation.

To achieve the above object, according to an aspect of the present invention, the hydraulic drive system for a construction machine comprises a hydraulic pump driven by a prime mover, actuators driven by a hydraulic fluid delivered from the hydraulic pump, flow control valves for leading flows of the hydraulic fluid supplied from the hydraulic pump to the actuators, operation means for operating the flow control valves, a relief valve for setting a relief pressure for limiting the maximum delivery pressure of the hydraulic pump, and relief pressure change means for increasing or decreasing the relief pressure set by the relief valve; wherein the relief pressure change means increases or decreases the relief pressure in accordance with the input amount of the operation means.

That is, when an operator operates the operation means of an arm flow control valve in order to operate a working machine of a construction machine such as an arm of a hydraulic excavator, the hydraulic fluid delivered from a hydraulic pump driven by a prime mover is led to a corresponding actuator, that is, an arm cylinder and thereby, the arm cylinder operates and arm dumping or arm crowding is performed. This time, in this case, though the maximum delivery pressure of the hydraulic pump is limited by a relief pressure set by a relief valve, the relief pressure is increased or decreased by relief pressure change means in accordance with the input amount of operation means.

Thereby, when a heavy operation requiring a very large power such as load lifting or heavy excavating is performed, a relief pressure is automatically increased because the input amount of operation means becomes large. Therefore, a large power can be obtained by operating the arm cylinder when the cylinder load is large. On the other hand, when a light operation requiring no large power such as grading is performed, the relief pressure is not increased because the input amount of the operation means becomes small. Thereby, when the load pressure of the arm cylinder rises, that is, when the arm cylinder reaches its stroke end and so forth, it is possible to prevent the load applied to the arm cylinder from excessively increasing and improve the service life of equipment.

As described above, because a relief pressure is automatically increased or decreased in accordance with the input amount of operation means, the conventional switch operation for increasing or decreasing the relief pressure is unnecessary and the operability for an operator can be improved.

In the hydraulic drive system for a construction machine, preferably, the relief pressure change means includes change switching means for switching whether to perform increase or decrease of the relief pressure or not in accordance with an input amount of the operation means.

In the hydraulic drive system for a construction machine, preferably, the change switching means has a solenoid valve located at a line for leading hydraulic fluid supplied from a hydraulic source to a back pressure chamber of the relief valve for connecting or disconnecting the line and switching control means for outputting a driving signal for switching the solenoid valve to a disconnecting position when the input amount of the operation means is less than a predetermined threshold and outputting a driving signal for switching the solenoid valve to a connecting position when the input amount is equal to or more than the predetermined threshold.

In the hydraulic drive system for a construction machine, preferably, the solenoid valve included in the change switching means comprises a solenoid proportional valve in which a spool is displaced proportionally to a driving signal input and the switching control means changes the driving signal for the solenoid proportional valve in a plurality of steps to change a position of the spool in a plurality of steps in a region in which the input amount of the operation means is equal to or more than the predetermined threshold.

That is, because fine stepwise adjustment of the amount of pressure increase can be made by switching the hydraulic pressure led from the hydraulic source to the back pressure chamber of the relief valve in a plurality of steps by using the solenoid proportional valve, it is possible to obtain a necessary minimum pressure increase corresponding to the operation purpose. For example, when the power required for heavy excavating is not necessary though the normal relief pressure is insufficient for excavating in power, it is possible to obtain a relatively small pressure increase. Thereby, because the load applied to an actuator can be prevented from excessively increasing, it is possible to improve the service life of equipment.

In the hydraulic drive system for a construction machine, preferably, the flow control valve includes a pilot-operation-type valve driven by a pilot pressure, and the change switching means includes a hydraulic switching valve located at a line for leading a hydraulic fluid supplied from a hydraulic source to a back pressure chamber of the relief valve, provided with a driving section working in the direction of connecting the line when the maximum value of the pilot pressure is led to the section and a spring whose force works in the direction of disconnecting the line, and for connecting or disconnecting the line in accordance with the balance between a force due to the maximum pilot pressure and the force of the spring.

Preferably, the above hydraulic drive system for a construction machine further comprises instruction means making it possible to manually input an instruction to the relief pressure change means so as to increase the relief pressure independently of the input amount of the operation means.

Thereby, because it is possible to manually instruct the relief pressure change means to constantly automatically increase the relief pressure, this is effective for a case in which a large load pressure may continuously be applied to an actuator when heavy excavation is continued for a long time and so forth. Therefore, because an operator can select two types of operation methods such as automatic pressure increase corresponding to the input amount and continuous automatic pressure increase independent of the input amount according to necessity, it is possible to further improve the operability.

In the hydraulic drive system for a construction machine, preferably, the instruction means includes an ON-OFF switch provided with an ON position and an OFF position.

In the hydraulic drive system for a construction machine, preferably, the instruction means includes a rotary switch.

In the hydraulic drive system for a construction machine, preferably, the instruction means includes a seesaw-type two-position changeover switch.

Preferably, the above hydraulic drive system for a construction machine further comprises switching selection means making it possible to selectively manually input whether to execute or interrupt a switching operation by the change switching means.

Preferably, the above hydraulic drive system for a construction machine further comprises mode selection means for making it possible to manually selectively input an excavation mode wherein a selection by the mode selection means is interlocked with a selection by the switching selection means.

Thereby, it is also possible to select the execution or interruption of automatic pressure-increasing function correspondingly to the selection of an operation mode. That is, for instance, because automatic pressure increase corresponding to an input amount is performed only when heavy excavation is performed but the automatic pressure increase is interrupted for excavation other than the heavy excavation and fine operation, it is possible to further improve the operability. Moreover, because a relief pressure is kept at the normal value without increasing even if an input amount is temporarily increased due to a reason for operation at the time of excavation or fine operation, it is possible to securely obtain the original equipment service-life improvement effect of a relief valve.

In the hydraulic drive system for a construction machine, preferably, the mode selection means includes a rotary switch.

In the hydraulic drive system for a construction machine, preferably, the mode selection means includes a combination of a plurality of ON-OFF switches provided with an ON position and an OFF position.

In the hydraulic drive system for a construction machine, preferably, the switching selection means includes a seesaw-type two-position changeover switch provided with an ON position and an OFF position.

Preferably, the above hydraulic drive system for a construction machine further comprises input-amount detection means for detecting an input amount of the operation means wherein the flow control valve includes a pilot-operation-type valve driven by a pilot pressure, the operation means includes a control lever and a pressure reducing valve for reducing a pressure of hydraulic fluid supplied from a hydraulic source and producing a pilot pressure corresponding to a operating position of the control lever, and the input-amount detection means includes a pressure sensor for detecting the pilot pressure produced by the pressure reducing valve.

In the hydraulic drive system for a construction machine, preferably, the flow control valve includes a pilot-operation-type valve driven by a pilot pressure and the operation means includes an electric control lever and a potentiometer for outputting a signal corresponding to the operating position of the electric control lever.

Preferably, the above hydraulic drive system for a construction machine further comprises input-amount detection means for detecting an input amount of the operation means wherein the input-amount detection means includes a stroke sensor for detecting a stroke of a spool provided with the flow control valve.

BRIEF DESCRIPTION OF THE DRAWINGS

FIG. 6 is an chart showing a corresponding relation between the combination of input amounts of a control-lever system with ON/OFF driving signals and an execution or an interruption of automatic pressure increase;

FIG. 9 is an chart showing a corresponding relation between the combination of input amounts of a control-lever system with a selection result of an operation mode and an execution or an interruption of automatic pressure increase;

FIG. 12 is an chart showing a corresponding relation between the combination of input amounts of a control-lever system, operation mode selection, and ON/OFF driving signals and an execution or an interruption of automatic pressure increase;

FIG. 21 is an chart showing a corresponding relation between the combination of input amounts of a control-lever system, operation mode selection, and signals of a rotary switch and an execution or an interruption of automatic pressure increase and amounts of pressure increase;

DETAILED DESCRIPTION OF THE PREFERRED EMBODIMENTS

Preferred embodiments of the present invention are described below by referring to the accompanying drawings.

The first embodiment of the present invention is described below by referring to FIGS. 1 to 3. This embodiment is an embodiment when using a hydraulic excavator as a construction machine to which the present invention is applied.

Figure 1:
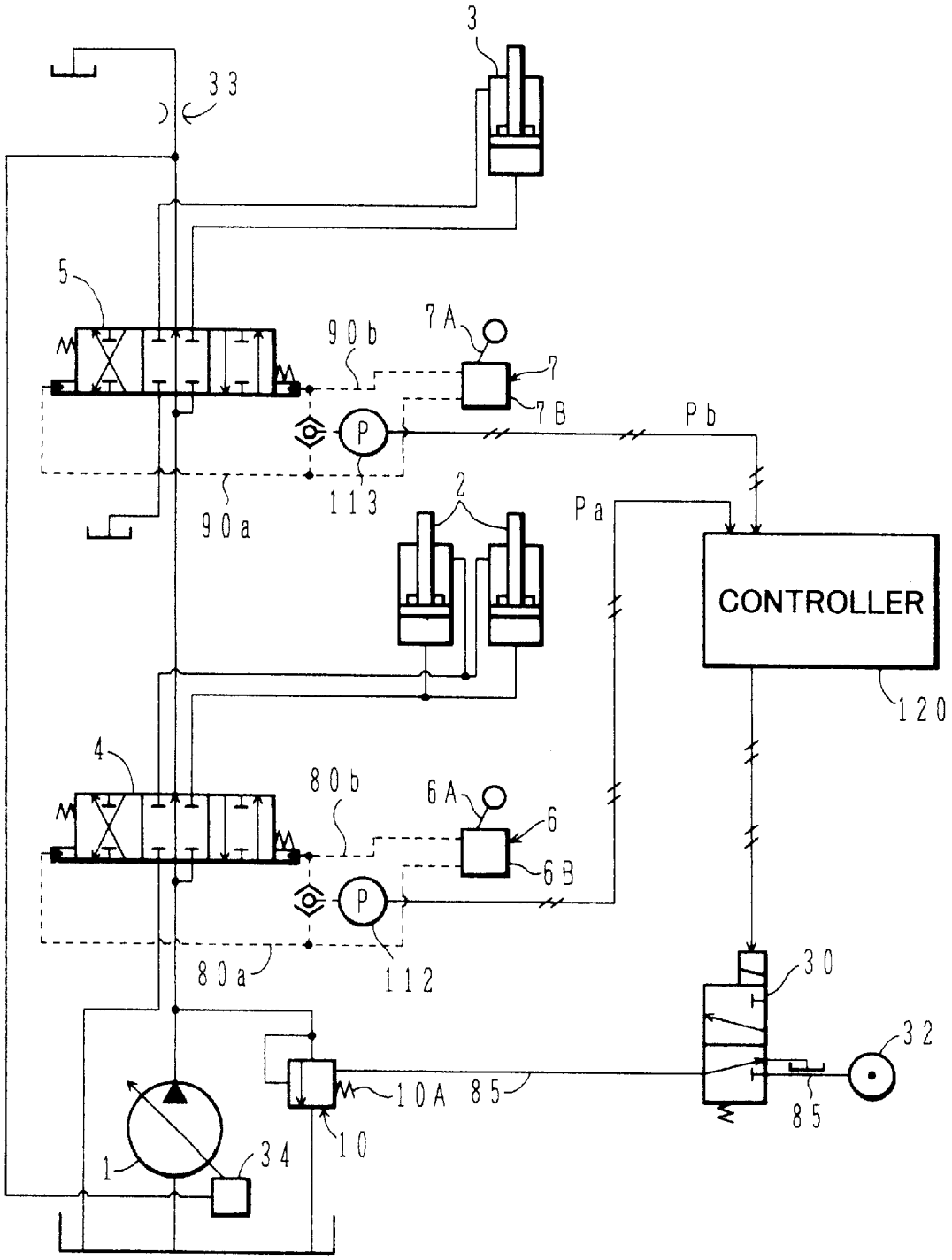
FIG. 1 is a hydraulic circuit diagram of the hydraulic drive system according to the first embodiment of the present invention.
Figure 24:
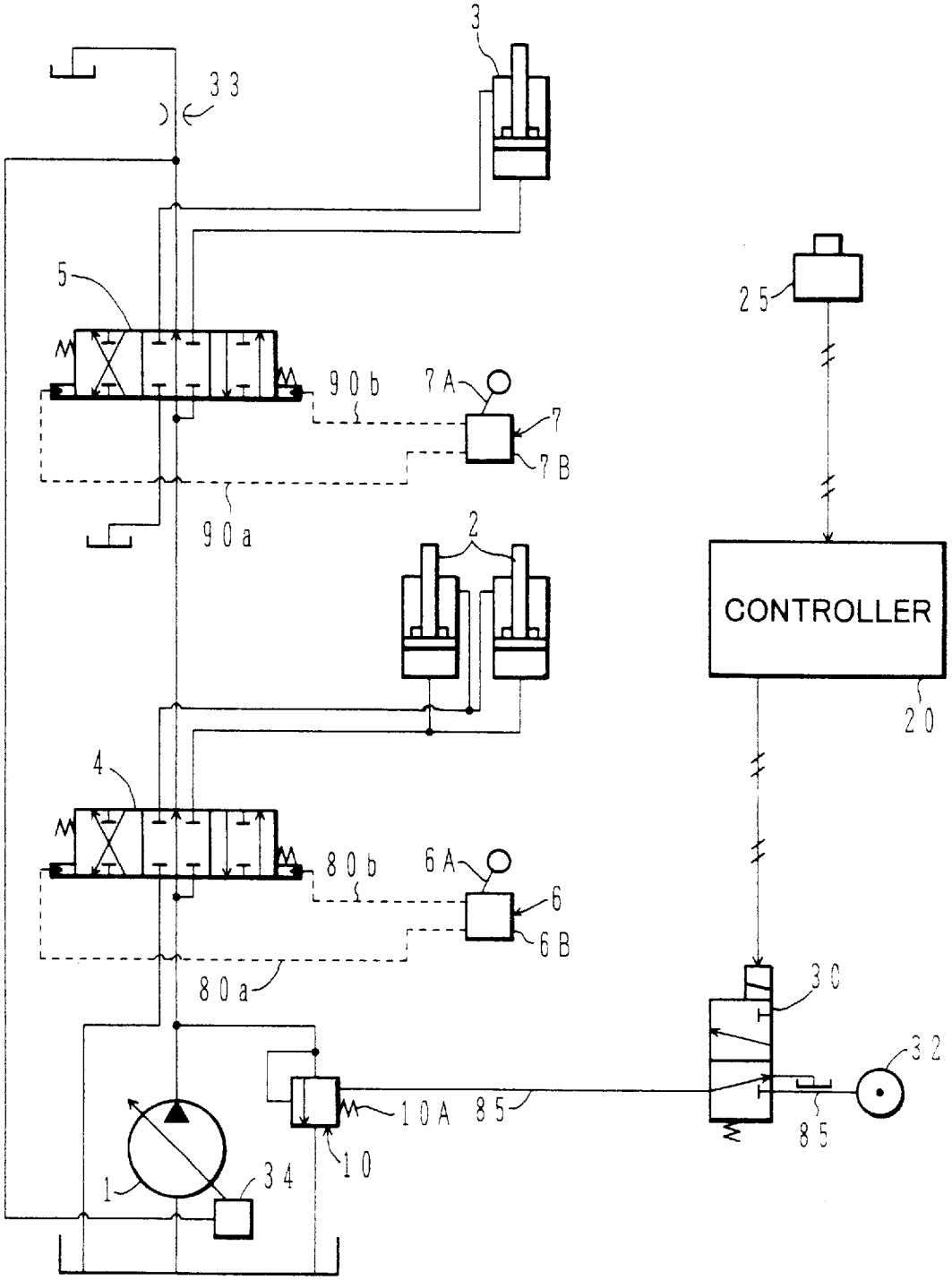
FIG. 24 PRIOR ART
FIG. 24 is a hydraulic circuit diagram of a hydraulic drive system according to the prior art.
Figure 25:
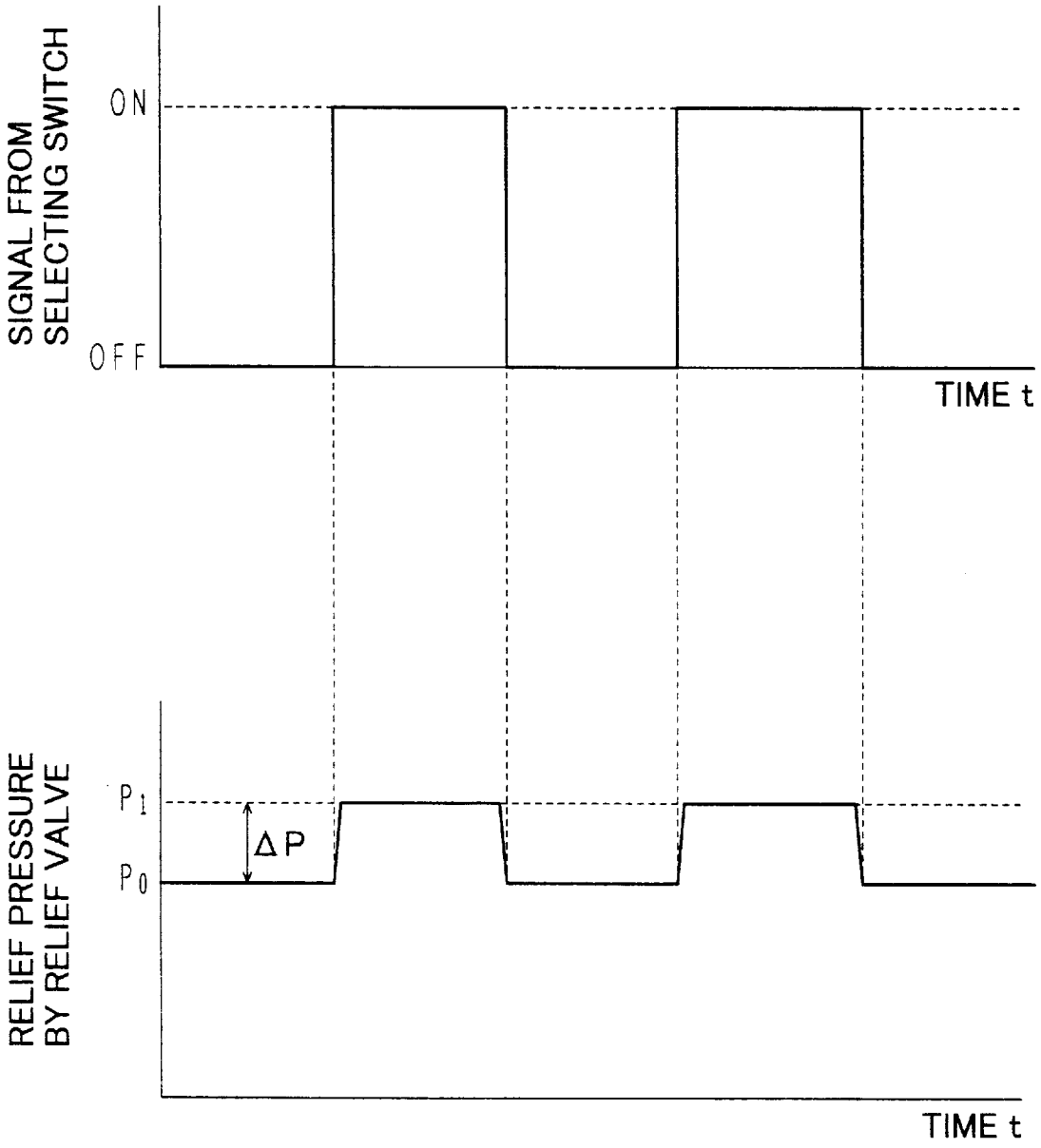
FIG.25 PRIOR ART
FIG. 25 is a graph showing a change of relief pressures to ON and OFF of the selecting switch shown in FIG. 24.

FIG. 1 shows a hydraulic circuit diagram of the hydraulic drive system according to this embodiment. Members which are the same as that in FIG. 24 describing a conventional structure are provided with the same symbols and their descriptions are omitted. The hydraulic drive system shown in FIG. 1 is different from the hydraulic drive system having the conventional structure shown in FIG. 24 particularly in that a pressure sensor 112 serving as input-amount detection means for detecting a maximum pressure Pa in the pilot lines $\mathbf{80}_a$ and $\mathbf{80}_b$ for leading a pilot pressure supplied from the control-lever system 6 to the driving section of the boom flow control valve 4 and a pressure sensor 113 serving as input-amount detection means for detecting a maximum pressure $P_b$ in the pilot lines 90$_a$ and 90$_b$ for leading the pilot pressure supplied from the control-lever system 7 to the driving section of the arm flow control valve 5 are included and the selecting switch 25 is omitted. Moreover, detection signals of these pressure sensors 112 and 113 are respectively input to a controller 120 and the controller 120 outputs a driving signal to the solenoid switching valve 30 in accordance with these detection signals.

Figure 2:
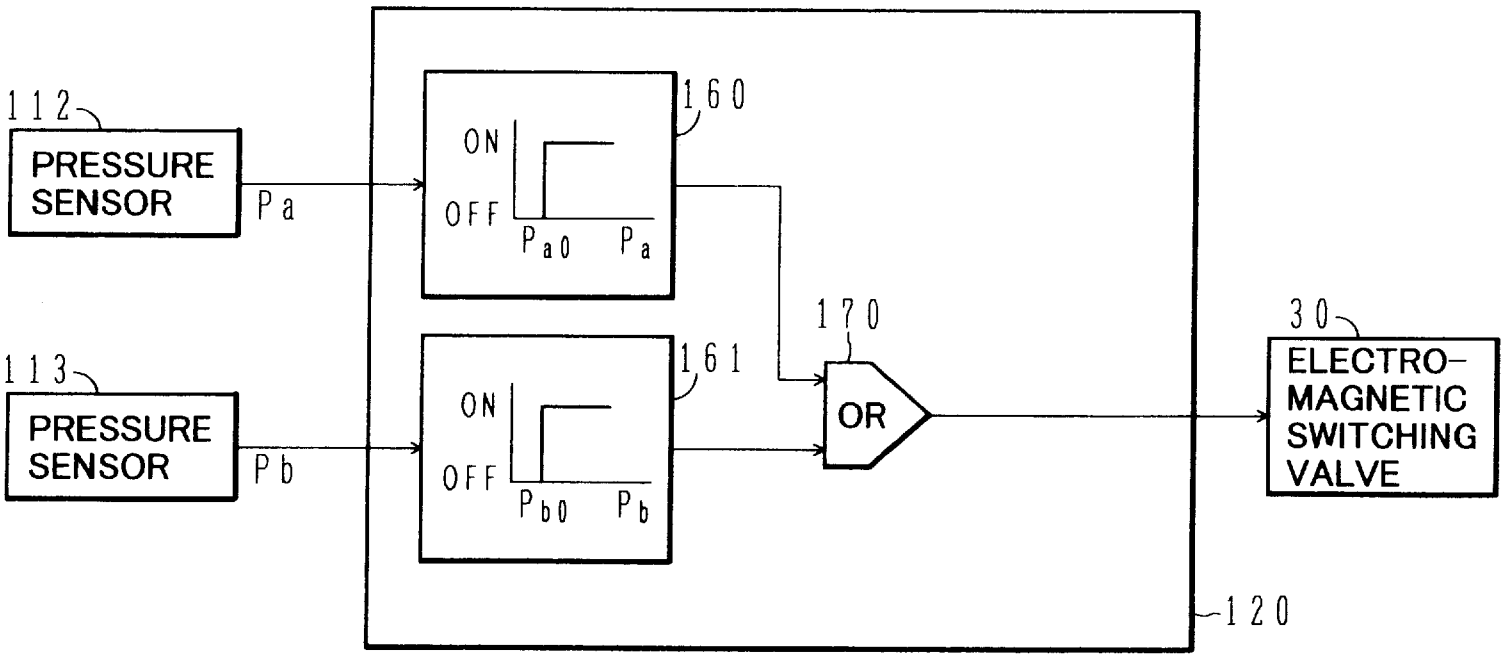
FIG. 2 is a functional block diagram showing a control function of the controller shown in FIG. 1.

FIG. 2 is a functional block diagram showing a control function of the controller 120, in which a first driving-signal generating section 160 for generating an ON/OFF driving signal for the solenoid switching valve 30 in accordance with a detection signal Pa output from the pressure sensor 112, a second driving-signal generating section 161 for generating an ON/OFF driving signal for the solenoid switching valve 30 in accordance with a detection signal Pb output from the pressure sensor 113, and an OR selecting section 170 for outputting an ON signal to the solenoid switching valve 30 when at least one of the first and second driving-signal generating sections 160 and 161 generates and outputs the ON signal.

The first and second driving-signal generating sections 160 and 161 respectively output an OFF driving signal for switching the solenoid switching valve 30 to a disconnecting position for disconnecting the line 85 when the pressure values $P_a$ and $P_b$ detected by the pressure sensors 112 and 113 are less than predetermined values $P_{a0}$ and $P_{b0}$ and output an ON driving signal for switching the valve 30 to the connecting position for connecting the line 85 when the values $P_a$ and $P_b$ are equal to or more than the predetermined values $P_{a0}$ and $P_{b0}$. In this case, the thresholds $P_{a0}$ and $P_{b0}$ are set so as to almost correspond to the boundary value between an input amount when performing a light operation requiring no large power such as grading and an input amount when performing a heavy operation requiring a particularly large power such as load lifting or heavy excavation.

Figure 3:
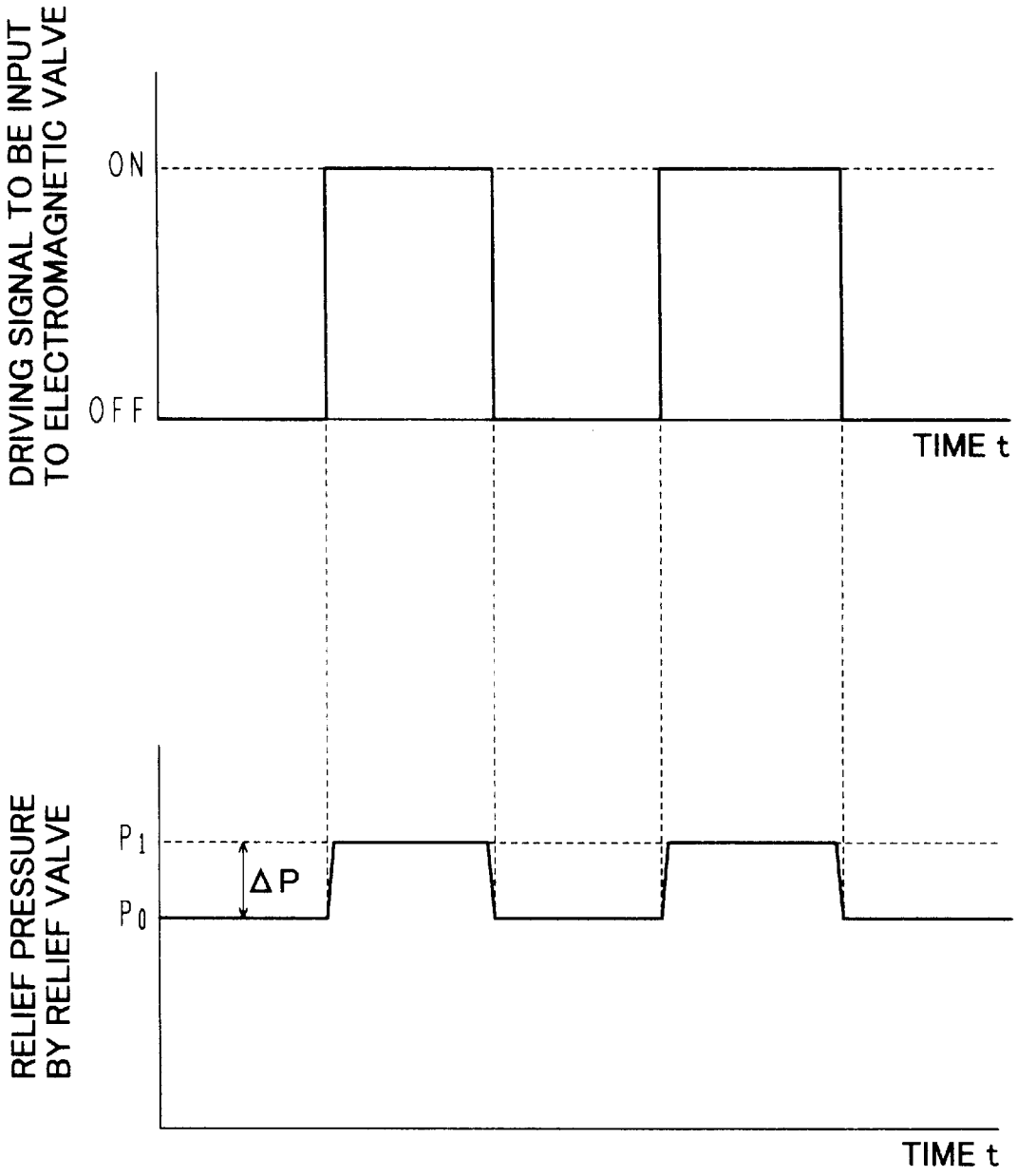
FIG. 3 is a graph showing an example of the relation between a driving signal input to the solenoid switching valve shown in FIG. 1 and a relief pressure set by a relief valve.

FIG. 3 shows an example of the relation between an ON/OFF driving signal input to the solenoid switching valve 30 and a relief pressure set by the relief valve 10. A case of setting the relief pressure of the relief valve 10 produced by the spring 10A to $P_0$ is shown similarly to the case of the conventional structure shown in FIG. 24. In this case, when an ON signal is input to the solenoid switching valve 30, the valve 30 is switched to the connecting position, the line 85 connects with the hydraulic source 32 and a hydraulic fluid is delivered from the hydraulic source 32 to the back pressure chamber of the relief valve 10, a predetermined pressure $\Delta P$ is applied to the back pressure chamber, and the relief pressure is increased by the pressure $\Delta P$ and the force of the spring 10A as shown in FIG. 3 and set to $P_1$. On the other hand, when an OFF signal is input to the solenoid switching valve 30, the valve 30 is switched to the disconnecting position, a hydraulic fluid in the line 85 is led to a reservoir, and the relief pressure is returned to $P_0$ by the force of the spring 10A.

In the above description, the controller 120 constitutes switching control means for outputting a driving signal for switching the solenoid switching valve 30 to the disconnecting position when the input amount of operation means is less than a predetermined threshold and outputting a driving signal for switching the valve 30 to the connecting position when the input amount of it is equal to or more than the predetermined threshold. Moreover, the controller 120 and the solenoid switching valve 30 constitute change switching means for switching whether to perform increase or decrease of the relief pressure or not in accordance with the input amount of the operation means, and the hydraulic source 32 and the line 85 constitute relief pressure change means for increasing or decreasing the relief pressure set by the relief valve 10, together with the above means.

In the hydraulic drive system of this embodiment constituted as described above, when an operator operates the control lever 7A in order to operate the arm of a hydraulic excavator, a spool (not illustrated) set in the arm flow control valve 5 is removed, thereby the hydraulic fluid delivered from the hydraulic pump 1 is led to and drives the arm cylinder 3, and arm dumping or arm crowding is performed. Moreover, a boom is similarly raised or lowered.

When the operation performed by the operator is a light operation requiring no large power such as grading, the input amounts of the control levers 6A and 7A of the control-lever systems 6 and 7 for operating the boom and arm become small and the pressure values $P_a$ and $P_b$ detected by the pressure sensors 112 and 113 become less than the thresholds $P_{a0}$ and $P_{b0}$. As a result, the driving signal output from the first or second driving-signal generating section 160 or 161 serves as an OFF signal and an OFF driving signal is output to the solenoid switching valve 30 from the OR selecting section 170. Therefore, the relief pressure of the relief valve 10 is not increased but it is set to the normal pressure $P_0$ set by the force of the spring 10A. Thereby, when the load pressure of the boom cylinder 2 and the arm cylinder 3 rises, that is when the boom cylinder 2 and arm cylinder 3 reach their stroke ends and so forth it is possible to prevent the loads applied to the cylinders 2 and 3 from excessively increasing and therefore, improve the service life of equipment.

On the other hand, when the operation performed by the operator is a heavy operation requiring a particularly large power such as load lifting or heavy excavation, the input amounts of the control levers 6A and 7A of the control-lever systems 6 and 7 for operating the boom or arm become large and at least one of the pressure values $P_a$ and $P_b$ detected by the pressure sensors 112 and 113 in this case becomes equal to the threshold $P_{a0}$ or $P_{b0}$ or more. As a result, the driving signal of at least one of the first and second driving-signal generating sections 160 and 161 serves an ON signal and an ON driving signal is output from the OR selecting section 170 to the solenoid switching valve 30. Therefore, the hydraulic fluid supplied from the hydraulic source 32 is led to the back pressure chamber of the relief valve 10 through the line 85 and the relief pressure of the relief valve 10 is increased from $P_0$ to $P_1$. Thereby, even for a large load pressure, it is possible to operate the cylinders 2 and 3 and obtain a large power.

As described above, because the relief pressure of the relief valve 10 is automatically increased or decreased in accordance with the input amounts of the control levers 6A and 7A, the switching operation for increase or decrease of relief pressure conventionally performed is unnecessary and it is possible to improve the operability for an operator.

The second embodiment of the present invention is described below by referring to FIGS. 4 and 5. This embodiment is provided with instruction means making it possible to manually input an instruction so as to automatically increase a relief pressure independently of the input amount of operation means. Members which are the same as those used for the first embodiment are provided with the same symbols and their descriptions are omitted.

Figure 4:
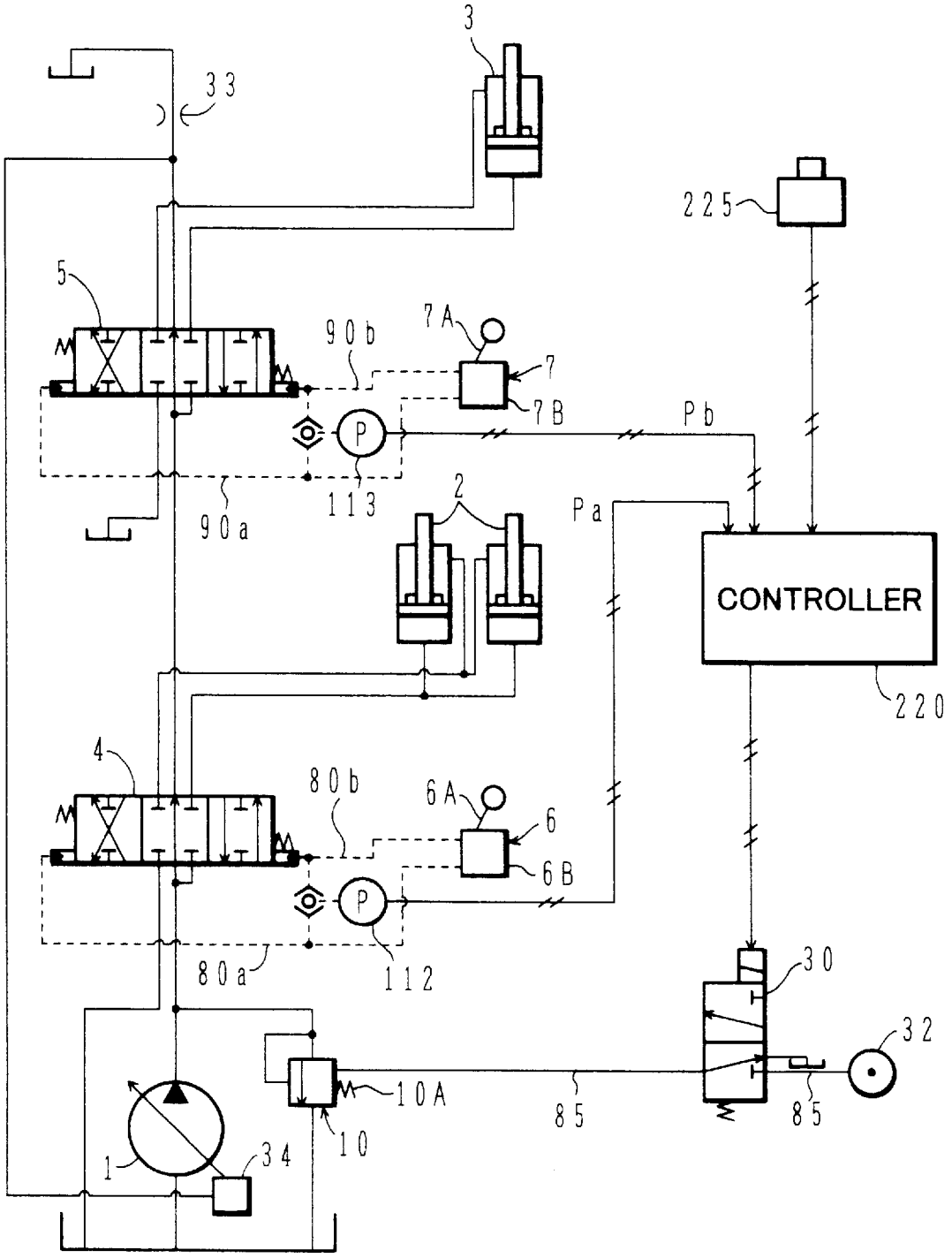
FIG. 4 is a hydraulic circuit of the hydraulic drive system according to the second embodiment of the present invention.

FIG. 4 is a hydraulic circuit diagram of the hydraulic drive system according to this embodiment. The hydraulic drive system of this embodiment is different from the hydraulic drive system according to the first embodiment shown in FIG. 1 particularly in that an ON-OFF switch 225 is included as instruction means making it possible to manually input an instruction to a controller 220 so as to increase a relief pressure independently of an input amount. Moreover, an ON/OFF driving signal output from the ON-OFF switch 225 is input to the controller 220 and the controller 220 outputs an ON/OFF driving signal to the solenoid switching valve 30 correspondingly to the detection signal output from the pressure sensor 112 or 113 and the signal output from the switch 225.

Figure 5:
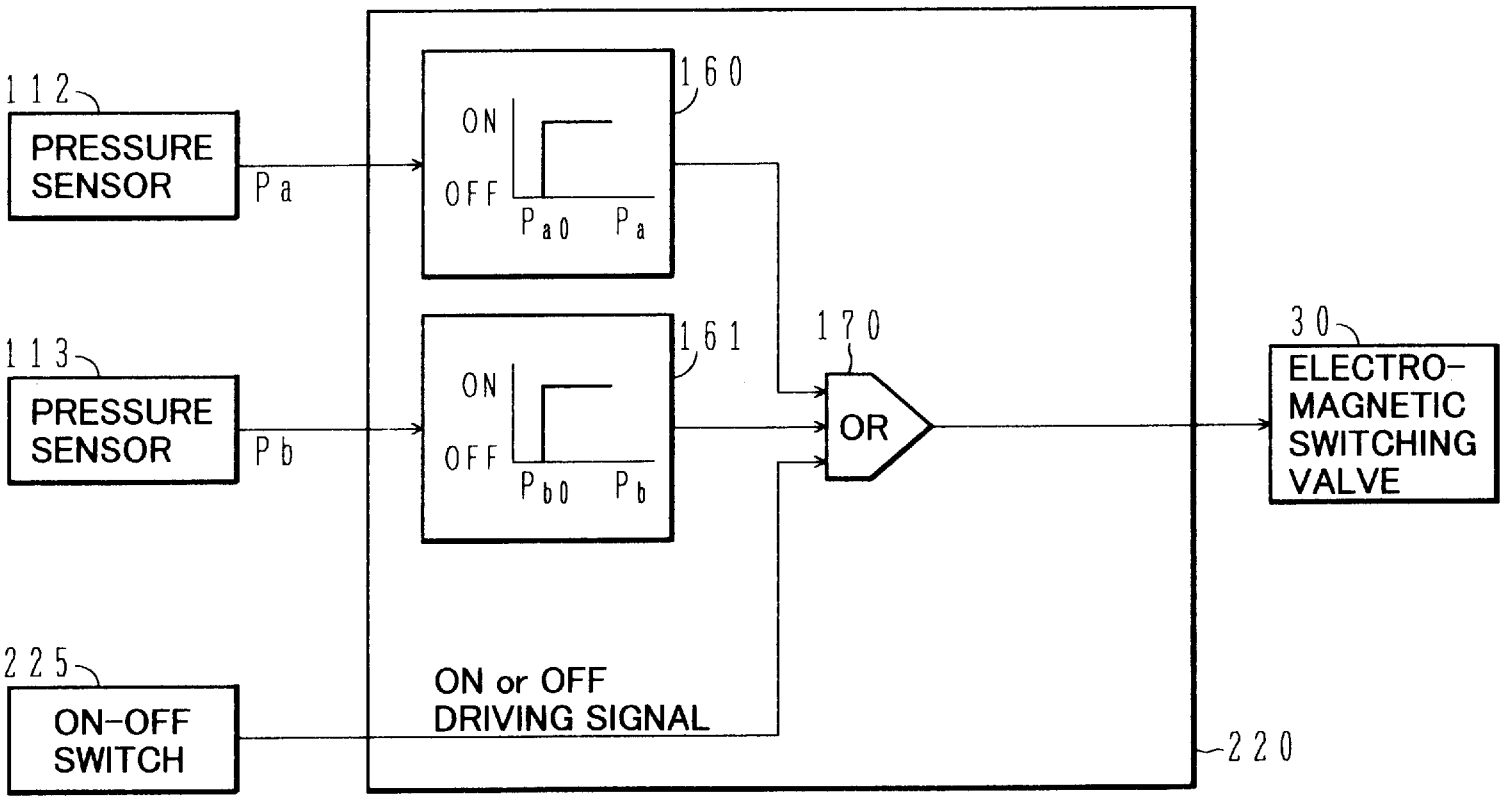
FIG. 5 is a functional block diagram showing a control function of the controller shown in FIG. 4.

FIG. 5 is a functional block diagram showing a control function of the controller 220 and the control function is different from the control function of the controller 120 of the first embodiment shown in FIG. 2 in that ON/OFF driving signals are input to the OR selecting section 170 from the first and second driving-signal generating sections 160 and 161 and the ON-OFF switch 225.

FIG. 6 shows a corresponding relation between the combination of input amounts of the control levers 6A and 7A of the control-lever systems 6 and 7 with ON/OFF driving signals and an execution or an interruption of automatic pressure increase.

That is, a relief pressure is increased independently of the amount of signals output from the pressure sensors 112 and 113 when an ON driving signal is output from the ON-OFF switch 225 and a relief pressure is set in accordance with the amount of signals output from the pressure sensors 112 and 113 when an OFF signal is output from the switch 225.

Structures and functions other than the above mentioned are almost the same as those of the first embodiment.

In the above description, the controller 220 constitutes switching control means for outputting a driving signal for switching the solenoid switching valve 30 to the disconnecting position when the input amount of operation means is less than a predetermined threshold and outputting a driving signal for switching the solenoid switching valve 30 to the connecting position when the input amount of it is equal to or more than the predetermined threshold. Moreover, the controller 220 and the solenoid switching valve 30 constitute change switching means for switching whether to perform increase or decrease of a relief pressure or not in accordance with the input amount of the operation means. Furthermore, the hydraulic source 32 and the line 85 constitute relief pressure change means for increasing or decreasing the relief pressure set by the relief valve 10, together with the above means.

This embodiment makes it possible to constantly automatically increase a relief pressure by manually turning on the ON-OFF switch 225. Therefore, this is specially effective when it is estimated that a large load pressure is continuously applied to the cylinders 2 and 3, that is, when heavy excavating is continued for a long time. Moreover, it is possible to perform automatic pressure increase corresponding to an input amount as the case of the first embodiment by manually turning off the ON-OFF switch 225. That is, because an operator can select these two types of operation methods according to necessity, it is possible to further improve the operability.

The third embodiment of the present invention is described below by referring to FIGS. 7 and 8. In this embodiment, switching selection means making it possible to manually select and input the execution or interruption of automatic pressure-increasing function and mode selection means making it possible to manually select and input the excavation mode are provided and the switching selection means and the mode selection means are interlocked with each other. Members which are the same as those used for the first and second embodiments are provided with the same symbols and their descriptions are omitted.

Figure 7:
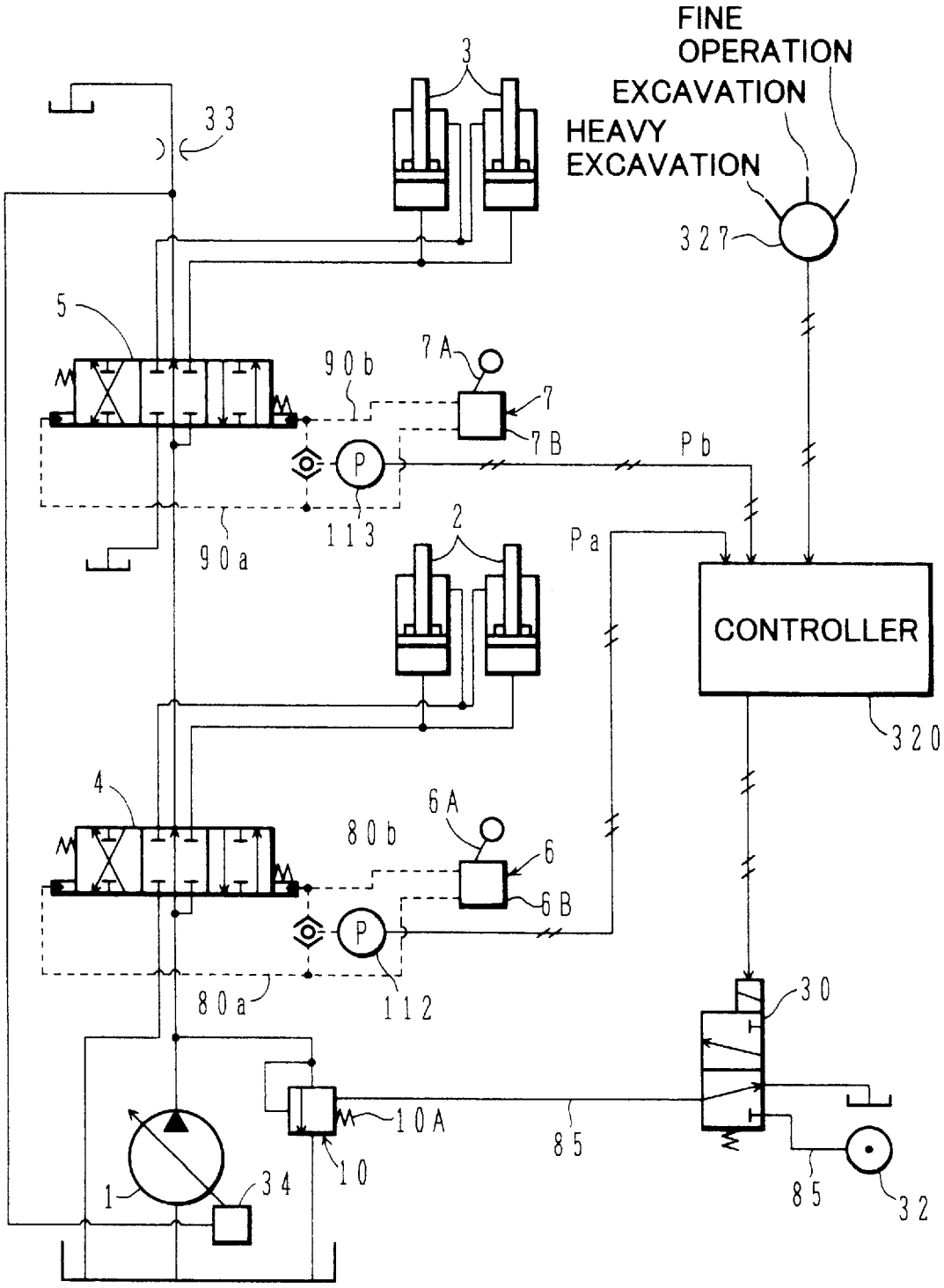
FIG. 7 is a hydraulic circuit diagram of the hydraulic drive system according to the third embodiment of the present invention.

FIG. 7 is a hydraulic circuit diagram of the hydraulic drive system according to this embodiment. The hydraulic drive system of this embodiment is different from the hydraulic drive system according to the first embodiment shown in FIG. 1 particularly in that a three-position-type rotary switch 327 for manually selecting and inputting the excavation modes such as a heavy excavation mode, an excavation mode, and a fine operation mode to a controller 320 is used as the above-described mode selection means and switching selection means. Moreover, a signal showing a selection result of the rotary switch 327 is input to the controller 320 and the controller 320 outputs an ON/OFF driving signal to the solenoid switching valve 30 correspondingly to the detection signal output from the pressure sensor 112 or 113 and the signal output from the switch 327. In this case, the effect of operation mode selection by the rotary switch 327 is the same as an already-known one of this type of the function and therefore, details of the effect are not described. However, the effect is roughly described below. That is, by selecting any one of the operation modes such as a heavy excavation, an excavation, and a fine operation, the table changes which shows control characteristics of the regulator 34 so that negative control having a characteristic suitable for the selected operation mode is applied to the hydraulic pump 1 or the speed of rotation of an engine for driving the hydraulic pump 1 changes.

Figure 8:
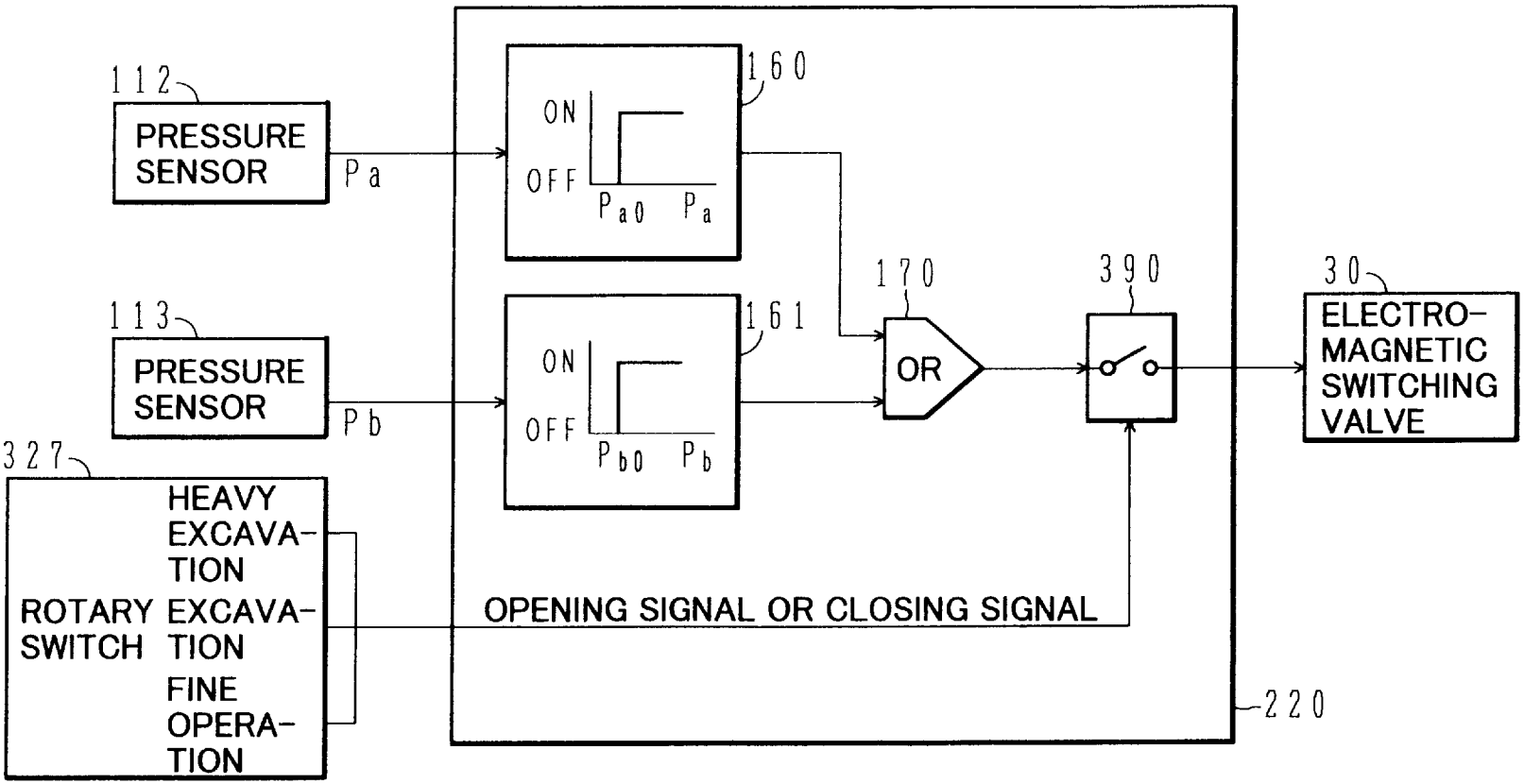
FIG. 8 is a functional block diagram showing a control function of the controller shown in FIG. 7.

FIG. 8 is a functional block diagram showing a control function of the controller 320. The control function of the controller 320 is different from the control function of the controller 120 of the first embodiment shown in FIG. 2 in that an ON/OFF driving signal output from the first or second driving-signal generating section 160 or 161 and selected by the OR selecting section 170 is connected or disconnected in accordance with the switching operation by a rotary switch section 390 to be opened or closed by an opening signal or closing signal output from the rotary switch 327. That is, when the "heavy excavation mode" is selected by the rotary switch 327, a closing signal is output to the rotary switch section 390 and the section 390 is closed and thereby, automatic pressure increase corresponding to an input amount is the case of the first embodiment is performed. Moreover, when the "excavation mode" or "fine operation mode" is selected by the rotary switch 327, an opening signal is output to the rotary switch section 390 and the section 390 opens and thereby, an ON/OFF driving signal output from the OR selecting section 170 is disconnected. Therefore, a normal relief pressure for improving the service life of equipment is constantly set.

FIG. 9 shows a corresponding relation between the combination of input amounts of the control levers 6A and 7A with operation mode selection results and an execution or an interruption of automatic pressure increase.

Structures and functions other than the above mentioned are almost the same as those of the first embodiment.

In the above description, the controller 320 constitutes switching control means for outputting a driving signal for switching the solenoid switching valve 30 to the disconnecting position when the input amount of operation means is less than a predetermined threshold and outputting a driving signal for switching the solenoid switching valve 30 to the connecting position when the input amount of it is equal to or more than the predetermined threshold. Moreover, the controller 320 and the solenoid switching valve 30 constitute change switching means for switching whether to perform increase or decrease of the relief pressure or not in accordance with the input amount of the operation means. Furthermore, the hydraulic source 32 and the line 85 constitute relief pressure change means for increasing or decreasing the relief pressure set by the relief valve 10, together with the above means.

This embodiment makes it possible to also select execution or interruption of automatic pressure-increasing function correspondingly to selection of operation modes. That is, it is possible to further improve the operability because automatic pressure increase corresponding to an input amount is executed only when heavy excavation is performed and the automatic pressure increase is interrupted when operations (excavation and fine operation) other than the heavy excavation are performed. Moreover, the relief pressure of the relief valve 10 is increased only when the heavy excavation mode is selected and an input amount becomes large but the relief pressure is not increased in cases other than the above case. Therefore, because a relief pressure is not increased but it is kept at the normal value even if an input amount is temporarily increased due to a reason for operation at the time of excavation or fine operation, it is possible to securely improve the equipment service life obtained due to an original function of the relief valve 10.

In the above-described third embodiment, three modes such as the heavy excavation mode, excavation mode, and fine operation mode are selected by the rotary switch 327. However, operation modes are not limited to the above three modes. Moreover, the case of performing automatic pressure increase is not limited to heavy excavation. Furthermore, though the rotary switch 327 uses the three-position type, it is also possible to use the four-or-more-position type or two-position type. Also in the above cases, the same effect is obtained by assigning an ON driving signal or an OFF driving signal to each operation mode.

The fourth embodiment of the present invention is described below by referring to FIGS. 10 and 11. This embodiment is provided with both the ON-OFF switch of the second embodiment and the rotary switch of the third embodiment. Members which are the same as those used for the first to third embodiments are provided with the same symbols and their descriptions are omitted.

Figure 10:
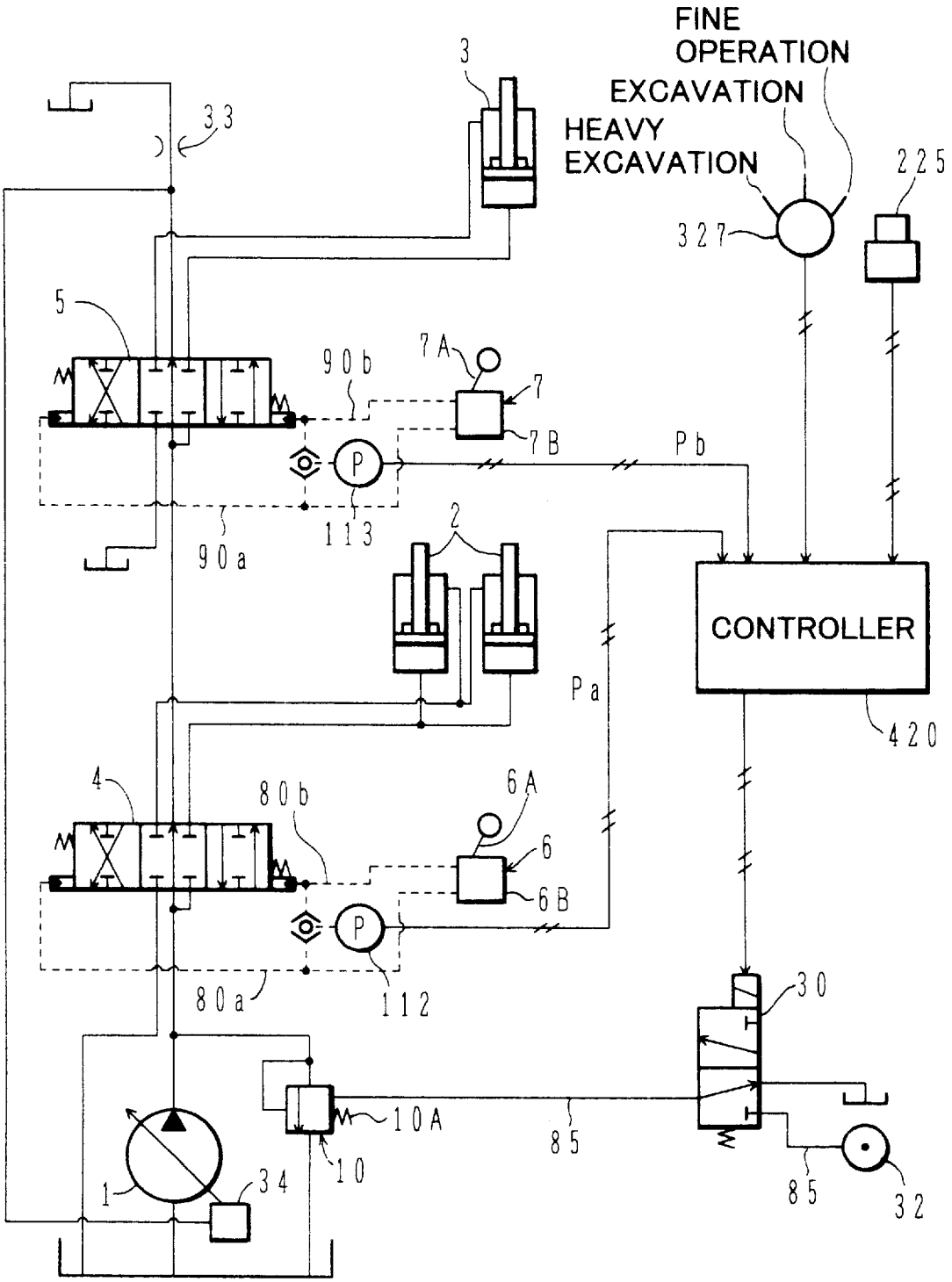
FIG. 10 is a hydraulic circuit diagram of the hydraulic drive system according to the fourth embodiment of the present invention.

FIG. 10 is a hydraulic circuit diagram of the hydraulic drive system according to this embodiment. The hydraulic drive system of this embodiment is different from the hydraulic drive system according to the third embodiment shown in FIG. 7 particularly in that the ON-OFF switch 225 same as that of the second embodiment for manually inputting an instruction for executing automatic pressure increase independently of an input amount to a controller 420 is used. Moreover, an ON/OFF driving signal output from the ON-OFF switch 225 is input to the controller 420 and the controller 420 outputs a driving signal to the solenoid switching valve 30 correspondingly to the detection signal output from the pressure sensor 112 or 113, the signal output from the rotary switch 327, and the signal output from the switch 225.

Figure 11:
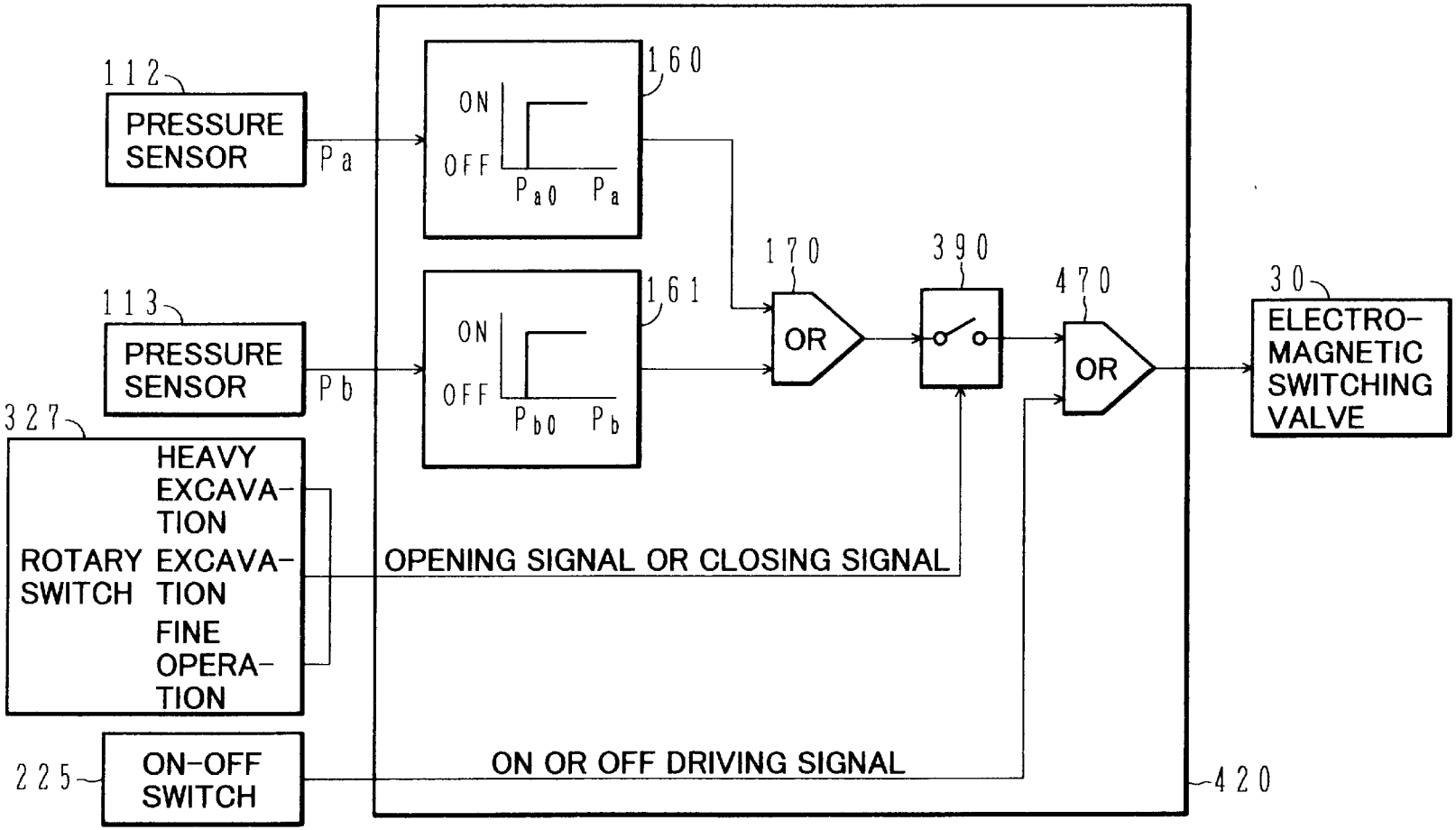
FIG. 11 is a functional block diagram showing a control function of the controller shown in FIG. 10.

FIG. 11 is a functional block diagram showing a control function of the controller 420. The control function of the controller 420 is different from the control function of the controller 320 of the third embodiment shown in FIG. 8 in that an ON/OFF driving signal selected by the OR selecting section 170 and then connected or disconnected by the switch section 390 opened or closed by an opening or closing signal output from the rotary switch 327 is input to an OR selecting section 470 further provided behind the switch section 390 and an ON/OFF driving signal output from the ON-OFF switch 225 is input to the OR selecting section 470.

That is, when the "heavy excavation mode" is selected by the rotary switch 327, a closing signal is output to the switch section 390 and the switch section 390 is closed and automatic pressure increase corresponding to an input amount is executed. Moreover, when the "excavation mode" or "fine operation mode" is selected by the rotary switch 327, an opening signal is output to the switch section 390 and the switch section 390 is opened and the ON/OFF driving signal output from the OR selecting section 170 is disconnected. However, also in this case, pressure increase can constantly be performed by manually turning on the ON-OFF switch 225. Therefore, this is effective when it is estimated that a large load pressure is continuously applied to the cylinders 2 and 3, that is, when a heavy operation is continued for a long time.

FIG. 12 shows a corresponding relation between the combination of input amounts of the control levers 6A and 7A, operation mode selection, and ON/OFF driving signals and an execution or an interruption of automatic pressure increase to be executed as the result of the above control.

Structures and functions other than the above mentioned are almost the same as those of the third embodiment.

In the above description, the controller 420 constitutes switching control means for outputting a driving signal for switching the solenoid switching valve 30 to the disconnecting position when the input amount of operation means is less than a predetermined threshold and outputting a driving signal for switching the solenoid switching valve 30 to a connecting position when the input amount of it is equal to or more than the predetermined threshold. Moreover, the controller 420 and the solenoid switching valve 30 constitute change switching means for switching whether to perform increase or decrease of the relief pressure or not in accordance with the input amount of the operation means. Furthermore, the hydraulic source 32 and the line 85 constitute relief pressure change means for increasing or decreasing the relief pressure set by the relief valve 10, together with the above means.

According to this embodiment, the advantages of the second and third embodiments can be obtained. That is, by turning off the ON-OFF switch 225, an advantage same as that used for the third embodiment can be obtained that automatic pressure increase corresponding to an input amount is executed only when heavy excavation is performed but it is interrupted when operations (excavation and fine operation) other than the heavy excavation are performed. Moreover, by manually turning on the ON-OFF switch 225, it is possible to constantly execute automatic pressure increase similarly to the case of the second embodiment.

The fifth embodiment of the present invention is described below by referring to FIGS. 13 and 14. This embodiment is provided with other types of input-amount detection means, instruction means, and switching selection means. Members which are the same as those used for the first to fourth embodiments are provided with the same symbols and their descriptions are omitted.

Figure 13:
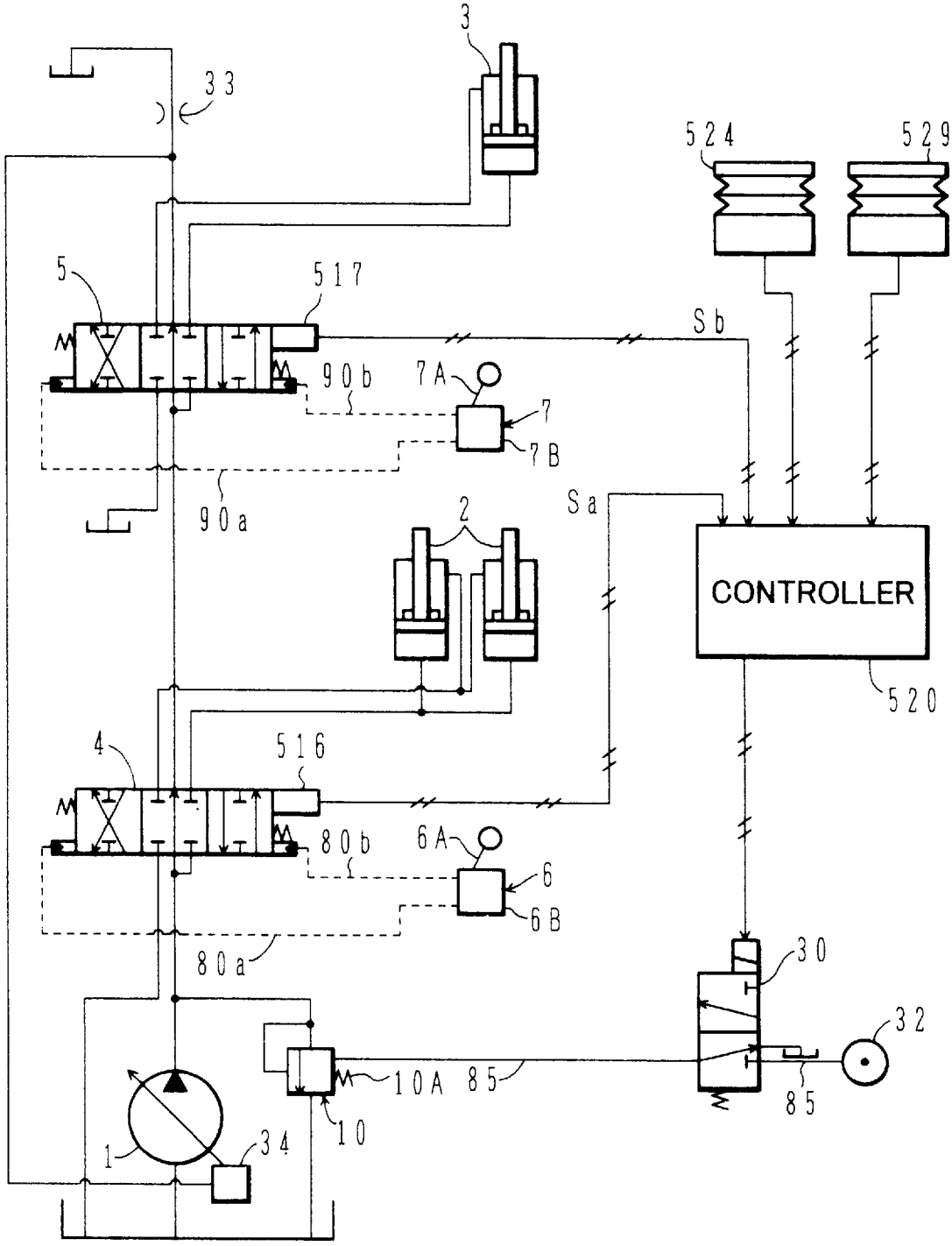
FIG. 13 is a hydraulic circuit diagram of the hydraulic drive system according to the fifth embodiment of the present invention.

FIG. 13 is a hydraulic circuit diagram of the hydraulic drive system according to this embodiment. The hydraulic drive system of this embodiment is different from the hydraulic drive system according to the fourth embodiment shown in FIG. 10 particularly in that stroke sensors 516 and 517 for directly detecting stroke values of spools (not illustrated) in the flow control valves 4 and 5 are used as input amount detection means of the control levers 6A and 7A instead of the pressure sensors 112 and 113, a seesaw-type two-position changeover switch 524 is used as instruction means making it possible to manually input an instruction for executing automatic pressure increase independently of an input amount instead of the ON-OFF switch 225, and a seesaw-type two-position changeover switch 529 is used as switching selection means making it possible to select excavation modes and manually select and input the execution or interruption of automatic pressure-increasing function instead of the rotary switch 327.

Figure 14:
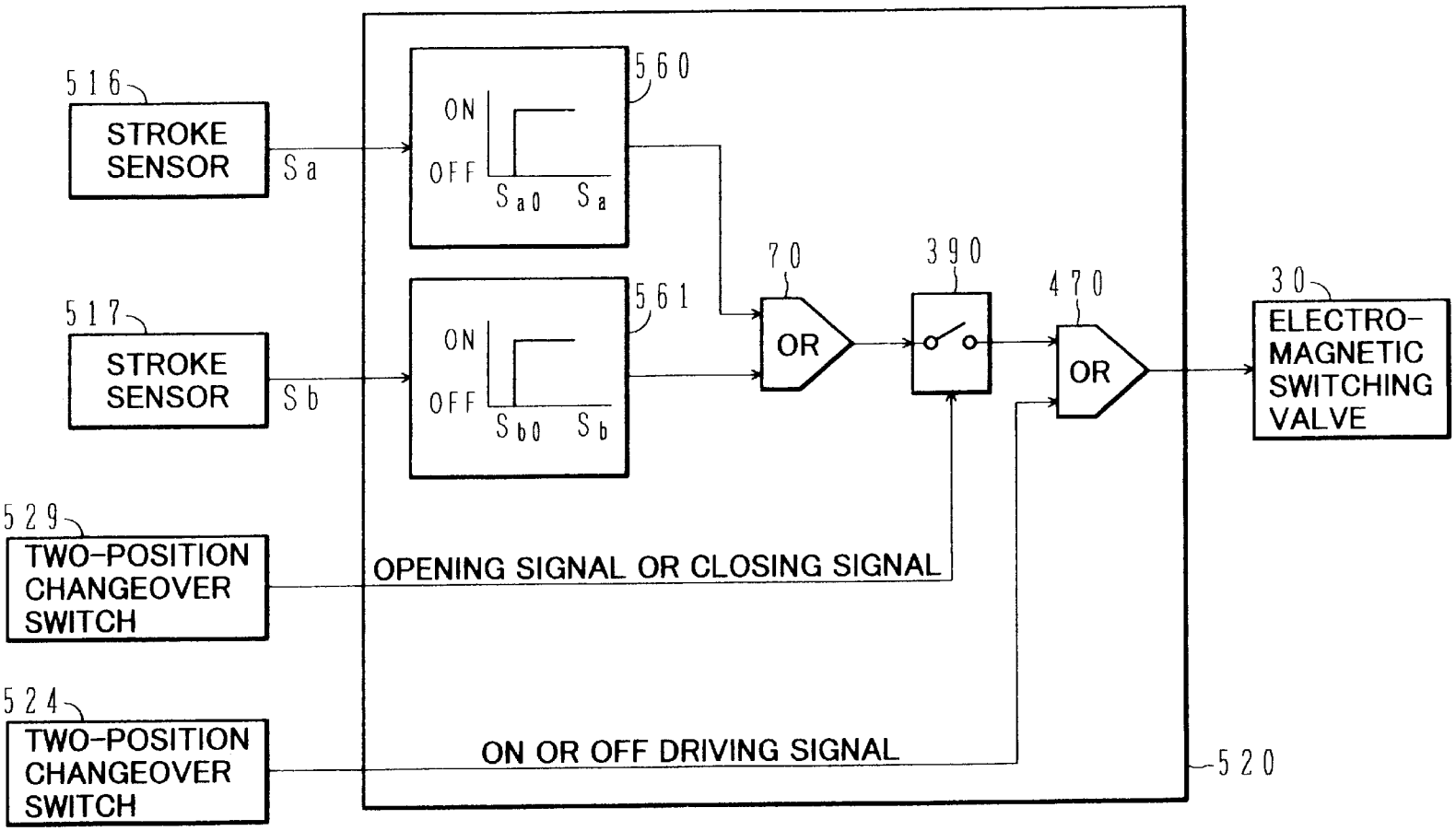
FIG. 14 is a functional block diagram showing a control function of the controller shown in FIG. 13.

FIG. 14 is a functional block diagram showing a control function of a controller 520. The control function of the controller 520 is different from the control function of the controller 420 of the fourth embodiment shown in FIG. 11 particularly in that first and second driving-signal generating sections 560 and 561 are used which generate an ON/OFF driving signal for the solenoid switching valve 30 in accordance with a detection signal $S_a$ or $S_b$ output from the stroke sensor 516 or 517. That is, the first and second driving-signal generating sections 560 and 561 respectively output an OFF driving signal for switching the solenoid switching valve 30 to the disconnecting position when the stroke values $S_a$ and $S_b$ detected by the stroke sensors 516 and 517 are less than predetermined thresholds $S_{a0}$ and $S_{b0}$ and output an ON driving signal for switching the solenoid switching valve 30 to the connecting position when the stroke values $S_a$ and $S_b$ are equal to or more than the values $S_{a0}$ and $S_{b0}$. In this case, the thresholds $S_{a0}$ and $S_{b0}$ are set so as to almost correspond to the boundary value between an input amount when performing a light operation requiring no large power such as grading and an input amount when performing a heavy operation requiring a particularly large power such as load lifting or heavy excavation.

Structures and functions other than the above mentioned are almost the same as those of the fourth embodiment.

In the above description, the controller 520 constitutes switching control means for outputting a driving signal for switching the solenoid switching valve 30 to the disconnecting position when the input amount of operation means is less than a predetermined threshold and outputting a driving signal for switching the solenoid switching valve 30 to the connecting position when the input amount of the operation means is equal to or more than the predetermined threshold. Moreover, the controller 520 and the solenoid switching valve 30 constitute change switching means for switching whether to perform increase or decrease of the relief pressure or not in accordance with the input amount of the operation means. Furthermore, the hydraulic source 32 and the line 85 constitute relief pressure change means for increasing or decreasing the relief pressure set by the relief valve 10, together with the above means.

The same advantage as the fourth embodiment can be obtained also by this embodiment.

The sixth embodiment of the present invention is described below by referring to FIGS. 15 and 16. This embodiment is provided with a pressure switch instead of a pressure sensor. Members which are the same as those used for the first to fifth embodiments are provided with the same symbols and their descriptions are omitted.

Figure 15:
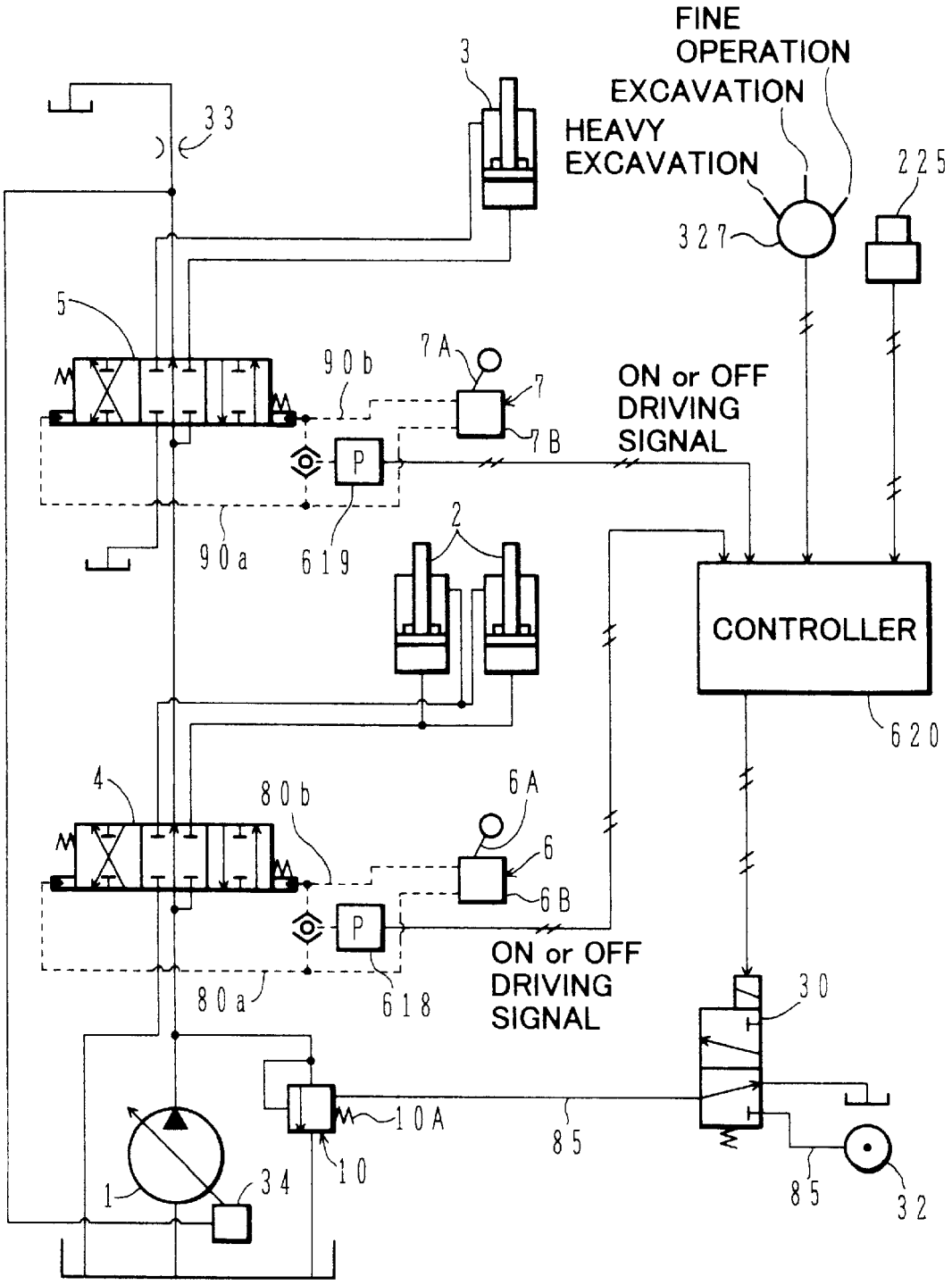
FIG. 15 is a hydraulic circuit diagram of the hydraulic drive system according to the sixth embodiment of the present invention.

FIG. 15 is a hydraulic circuit diagram of the hydraulic drive system according to this embodiment. The hydraulic drive system of this embodiment is different from the hydraulic drive system according to the fourth embodiment shown in FIG. 10 particularly in that pressure switches 618 and 619 for switching and outputting an ON/OFF driving signal for the solenoid switching valve 30 on the basis of a predetermined threshold are used instead of the pressure sensors 112 and 113. The thresholds of these pressure switches 618 and 619 are set so as to almost correspond to the boundary value between an input amount when performing a light operation requiring no large power such as grading and an input amount when performing a heavy operation requiring a particularly large power such as load lifting or heavy excavation. Therefore, the pressure switches 618 and 619 have the same functions as those of the first and second driving-signal generating sections 160 and 161 shown in FIG. 11. That is, the switches 618 and 619 output an OFF driving signal for switching the solenoid switching valve 30 to the disconnecting position when the maximum pressure in the pilot lines $\mathbf{80}_a$ and $\mathbf{80}_b$ or $\mathbf{90}_a$ and $\mathbf{90}_b$ is less than the threshold $P_{a0}$ or $P_{b0}$ and output an ON driving signal for switching the solenoid switching valve 30 to the connecting position when the maximum pressure in the pilot lines $\mathbf{80}_a$ and $\mathbf{80}_b$ or $\mathbf{90}_a$ and $\mathbf{90}_b$ is equal to or more than the threshold $P_{a0}$ or $P_{b0}$.

Figure 16:
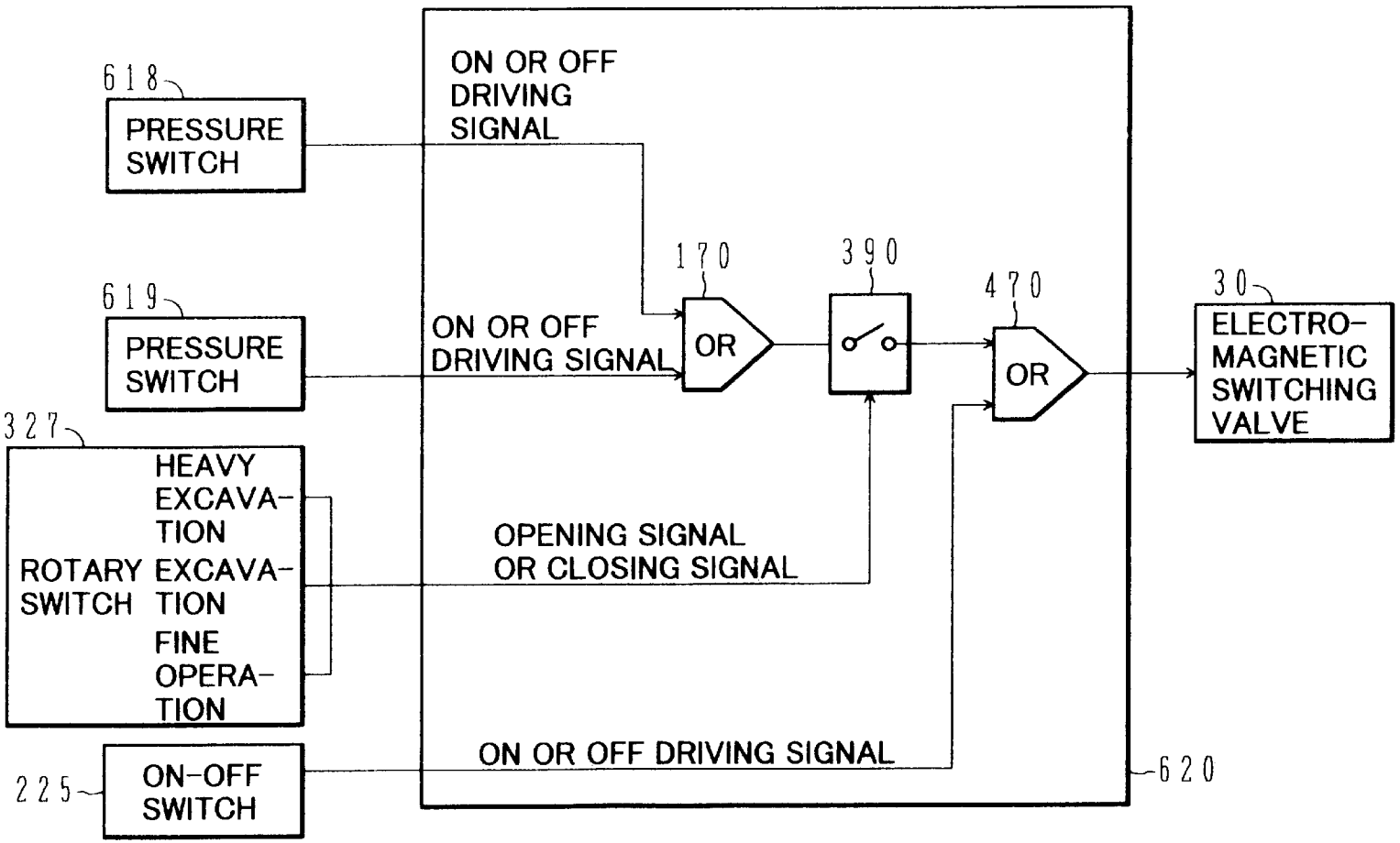
FIG. 16 is a functional block diagram showing a control function of the controller shown in FIG. 15.

FIG. 16 is a functional block diagram showing a control function of the controller 620. The control function of the controller 620 is different from the control function of the controller 420 of the fourth embodiment shown in FIG. 11 particularly in that the first and second driving-signal generating sections 160 and 161 are omitted and an ON driving signal or OFF driving signal output from the pressure switch 618 or 619 is directly input to the OR selecting section 170.

In the above description, the controller 620 and the pressure switches 618 and 619 constitute switching control means for outputting a driving signal for switching the solenoid switching valve 30 to the disconnecting position when the input amount of operation means is less than a predetermined threshold and outputting a driving signal for switching the solenoid switching valve 30 to the connecting position when the input amount of it is equal to or more than the predetermined threshold. Moreover, the controller 620, pressure switches 618 and 619, and solenoid switching valve 30 constitute change switching means for switching whether to perform increase or decrease of the relief pressure or not in accordance with the input amount of the operation means. Furthermore, the hydraulic source 32 and the line 85 constitute relief pressure change means for increasing or decreasing the relief pressure set by the relief valve 10, together with the above means.

The same advantage as the fourth embodiment can be obtained also by this embodiment.

The seventh embodiment of the present invention is described below by referring to FIGS. 17 to 19. This embodiment increases a relief pressure in two steps by using a solenoid proportional valve. Members which are the same as those used for the first to sixth embodiments are provided with the same symbols and their descriptions are omitted.

Figure 17:
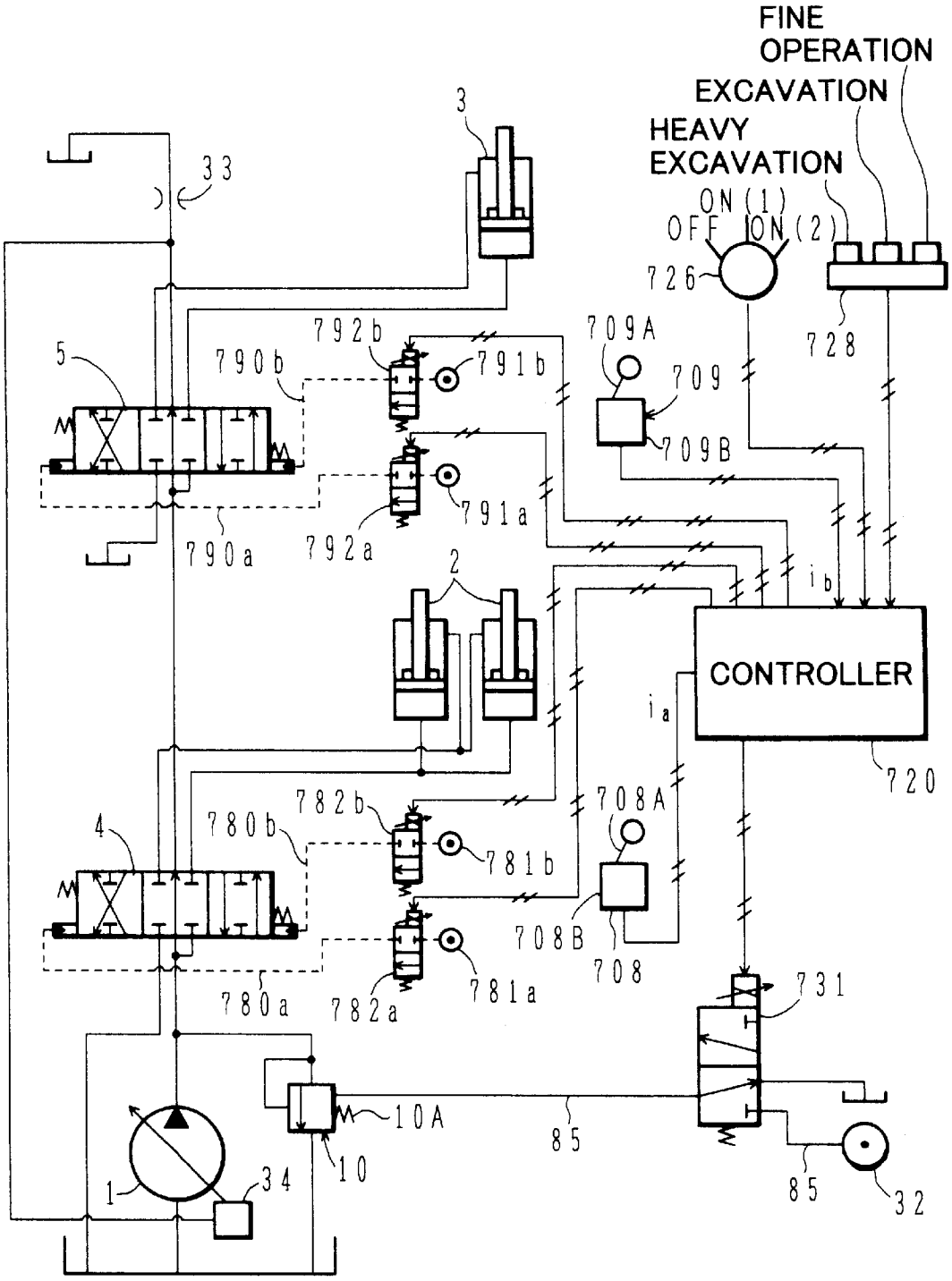
FIG. 17 is a hydraulic circuit diagram of the hydraulic drive system according to the seventh embodiment of the present invention.

FIG. 17 is a hydraulic circuit diagram of the hydraulic drive system according to this embodiment. The hydraulic drive system of this embodiment is different from the hydraulic drive system according to the first embodiment shown in FIG. 1 particularly in that the hydraulic drive system of this embodiment comprises a control-lever system 708 serving as operation means provided with an electric control lever 708A and a potentiometer 708B for outputting an input-amount signal $i_a$ corresponding to the operating position of the control lever 708A; a control-lever system 709 serving as operation means provided with an electric control lever 709A and a potentiometer 709B for outputting an input-amount signal $i_b$ corresponding to the operating position of the control lever 709A; a controller 720 for receiving the input-amount signals $i_a$ and $i_b$ from the potentiometers 708B and 709B and outputting a metering driving signal and relief-pressure increasing driving signal (to be both described later) corresponding to the signals $i_a$ and $i_b$; solenoid proportional valves $\mathbf{782}_a$, $\mathbf{782}_b$, $\mathbf{792}_a$, and $\mathbf{792}_b$ for reducing the pressure supplied from each of hydraulic sources (e.g. auxiliary hydraulic pumps) $\mathbf{781}_a$, $\mathbf{781}_b$, $\mathbf{791}_a$, and $\mathbf{791}_b$ in accordance with a metering driving signal output from the controller 720 and producing a pilot pressure; lines $\mathbf{780}_a$, $\mathbf{780}_b$, $\mathbf{790}_a$, and $\mathbf{790}_b$ for respectively leading the pilot pressures supplied from these solenoid proportional valves $\mathbf{782}_a$, $\mathbf{781}_b$, $\mathbf{791}_a$, and $\mathbf{791}_b$ to the driving sections of the flow control valves 4 and 5; a solenoid proportional valve 731 in which a spool is displaced proportionally to a relief pressure increasing driving signal output from the controller 720 for reducing the pressure supplied from the hydraulic source (e.g. auxiliary hydraulic pump) 32 and supplying the reduced pressure to the back pressure chamber of the relief valve 10 through the line 85 to increase or decrease the relief pressure of the relief valve 10; a three-position-type rotary switch 726 serving as instruction means making it possible to manually input an instruction for executing a predetermined amount of automatic pressure increase independently of an input amount to the controller 720; and a combination ON-OFF switch 728 serving as mode selection means making it possible to manually selectively input an operation mode such as the heavy excavation mode, excavation mode, or fine operation mode to the controller 720.

In the rotary switch 726, the following three positions can be switched: an ON(1) position and an ON(2) position for outputting a signal for instructing constant increase of a relief pressure and an OFF position for outputting an OFF signal for instructing proper increase of the relief pressure in accordance with an input amount. In this case, the ON(1) signal corresponds to the excavation mode of the switch 728 and the ON(2) signal corresponds to the heavy excavation mode of the switch 728, and the former further decreases the switching value of the solenoid switching valve 731 than the latter (details are described later).

The combination ON-OFF switch 728 is formed by arranging three ON-OFF switches provided with ON and OFF positions, in which, when any one of the switches is turned on, other switches are all turned off. Moreover, because the advantage of operation mode selection by the combination ON-OFF switch 728 is already known as to this type of the function similarly to the case of the switch 327 of the third embodiment, its detailed description is omitted.

Figure 18:
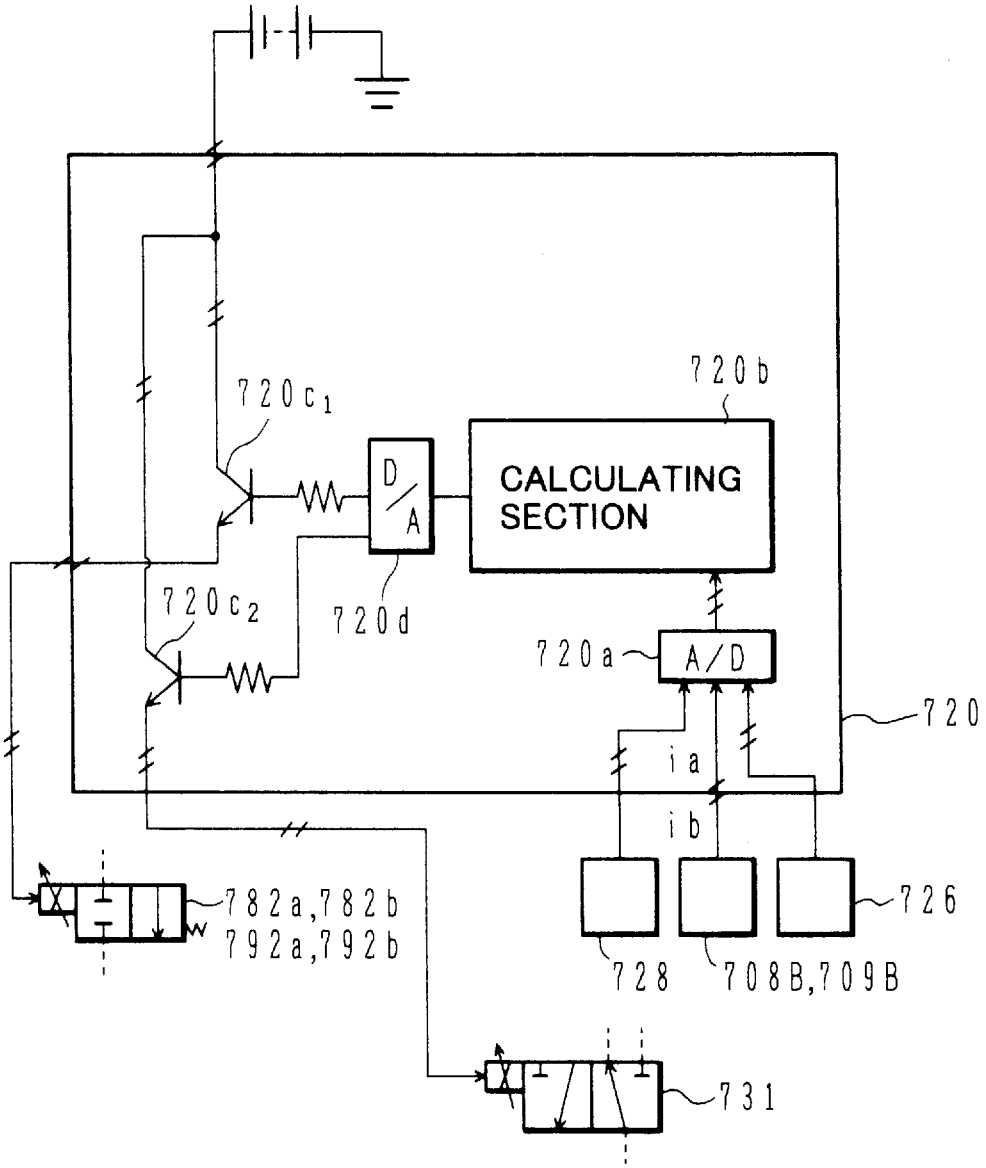
FIG. 18 is an illustration showing a detailed structure of the controller shown in FIG. 17.

FIG. 18 is a detailed structure of the controller 720, which is the same as that already known to as this type of the function. That is, in FIG. 18, the controller 720 is provided with an A-D converter $\mathbf{720}_a$ for converting the input-amount signals $i_a$ and $i_b$ output from the potentiometers 708B and 709B; ON(1), ON(2), and OFF signals output from the rotary switch 726, and a mode signal output from the combination ON-OFF switch 728 into digital signals; a calculating section $\mathbf{720}_b$ comprising a microcomputer to perform a predetermined operation in accordance with signals received from the A-D converter $\mathbf{720}_a$; a D-A converter $\mathbf{720}_d$ for converting a signal output from the calculating section $\mathbf{720}_b$ into an analog signal; and solenoid proportional driving circuits $\mathbf{720}_{c1}$, and $\mathbf{720}_{c2}$ for outputting metering and relief-pressure-increasing driving signals to the solenoid proportional valves $\mathbf{782}_a$, $\mathbf{782}_b$, $\mathbf{792}_a$, and $\mathbf{792}_b$, and 731 in accordance with a signal output from the D-A converter $\mathbf{720}_d$.

Thereby, when an operator operates the control levers 708A and 709A, required metering driving signals corresponding to the input amount detected by the potentiometer 708B or 709B are output to the solenoid proportional valves $\mathbf{782}_a$, $\mathbf{782}_b$, $\mathbf{792}_a$, and $\mathbf{792}_b$ from a solenoid proportional valve driving circuit $\mathbf{720}_{c1}$, a hydraulic fluid is supplied from the hydraulic sources $\mathbf{781}_a$, $\mathbf{781}_b$, $\mathbf{791}_a$, and $\mathbf{791}_b$ to the driving section of the corresponding flow control valve 4 or 5 through a corresponding solenoid proportional valve, and the corresponding flow control valve is switched. Therefore, it is possible to operate the boom cylinder 2 and the arm cylinder 3 at a speed corresponding to the input amount of the control lever 708A or 709A.

Figure 19:
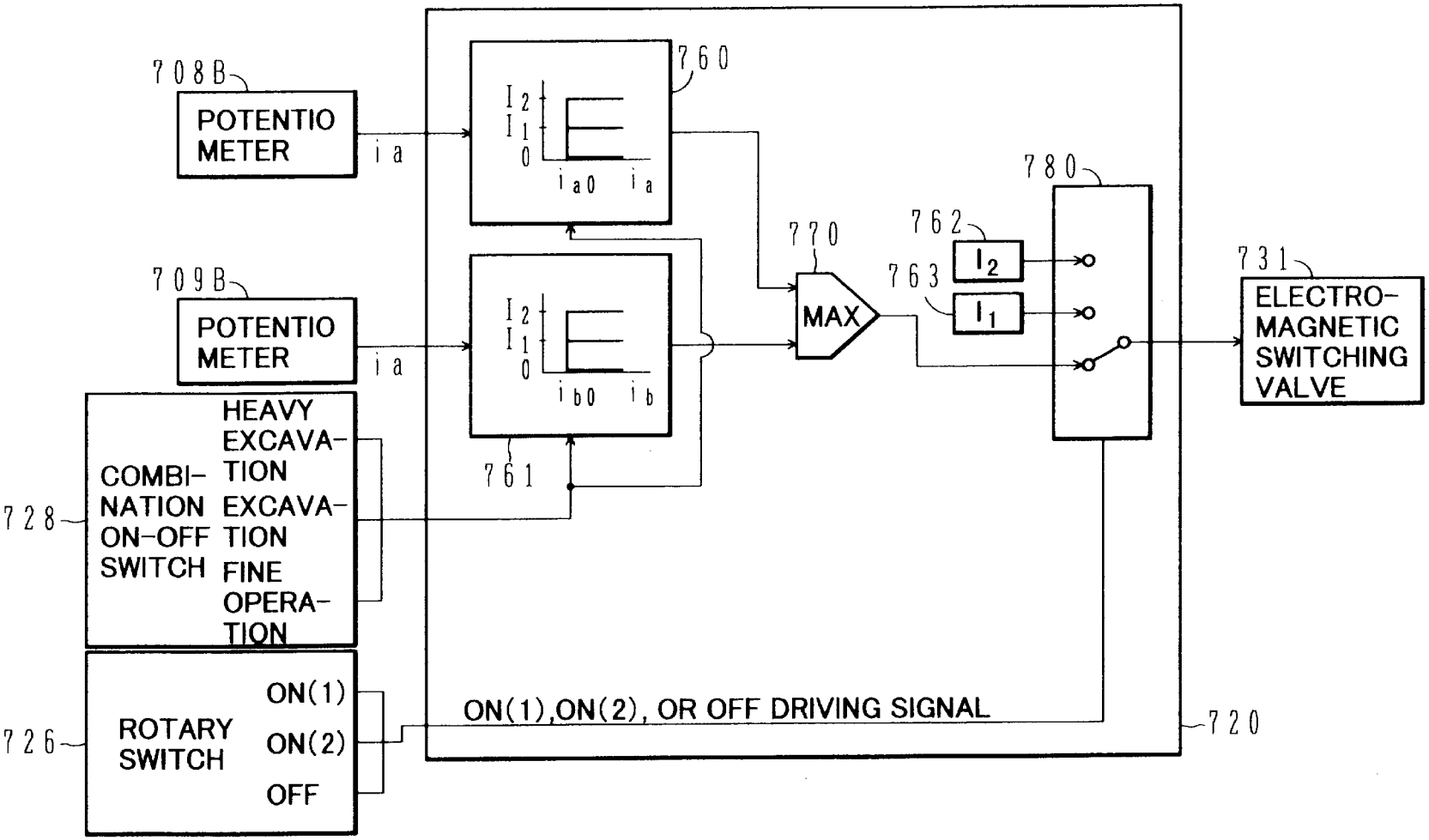
FIG. 19 is a functional block diagram showing a control function for increase of relief pressure among control functions of the controller shown in FIG. 17.

On the other hand, FIG. 19 is a functional block diagram showing a control function related to a relief pressure increase among the control functions of the controller 720 shown in FIG. 18, in which the controller 720 is provided with a first driving-signal generating section 760 for generating a driving signal having any one of the driving current values $I_2$, $I_1$, and 0 in accordance with the input-amount signal $i_a$ output from the potentiometer 708B and a mode selection result of the ON-OFF combination switch 728 and a second driving-signal generating section 761 for generating a driving signal having any one of the current values $I_2$, $I_1$, and 0 in accordance with the input-amount signal $i_b$ output from the potentiometer 709B and a mode selection result of the ON-OFF combination switch 728. That is, each of the first and second driving-signal generating sections 760 and 761 outputs a driving signal with a current value 0 for switching the solenoid proportional valve 731 to the disconnecting position when the current values $i_a$ and $i_b$ supplied from the potentiometers 709A and 709B are less than the predetermined thresholds $i_{a0}$ and $i_{b0}$. Moreover, when $i_a \geqq i_{a0}$ and $i_b \geqq i_{b0}$, the connection state of the line 85 is changed in two steps by changing a driving signal for the solenoid proportional valve 731 in two steps. That is, each of the sections 760 and 761 outputs a driving signal with a current value $I_2$ for switching the solenoid proportional valve 731 to the connecting position when the "heavy excavation mode" is selected by the switch 728, outputs a driving signal with a current value $I_1$ ($<I_2$) for switching the solenoid proportional valve 731 to a transient position between the connecting and disconnecting positions when the "excavation mode" is selected by the switch 728, and outputs a driving signal with a current value 0 for switching the solenoid proportional valve 731 to the disconnecting position when the "fine operation mode" is selected by the switch 728.

The controller 720 is further provided with a maximum-value selecting section 770, a switch section 780, a third driving-signal generating section 762 for outputting a driving signal with a current value $I_1$, and a fourth driving-signal generating section 763 for outputting a driving signal with a current value $I_2$, in which the maximum value of driving signals with current values 0 to $I_2$ generated by and output from the first and second driving-signal generating sections 760 and 761 is selected by the maximum-value selecting section 770 and then led to the switch 780. The switch section 780 is switched to any one of the OFF position, ON(1) position, and ON(2) position in accordance with a selection result of the rotary switch 726. That is, the switch section 780 outputs a driving signal with a current value $I_2$ from the fourth driving-signal generating section 763 to the solenoid proportional valve 731 when an ON(2) signal is output from the rotary switch 726, outputs a driving signal with a current value $I_1$ from the third driving-signal generating section 762 to the solenoid proportional valve 731 when an ON(1) signal is output from the rotary switch 726, and outputs a signal from the maximum-value selecting section 770 to the solenoid proportional valve 731 by being set to the position shown in FIG. 19 when an OFF signal is output from the rotary switch 726.

Figure 20:
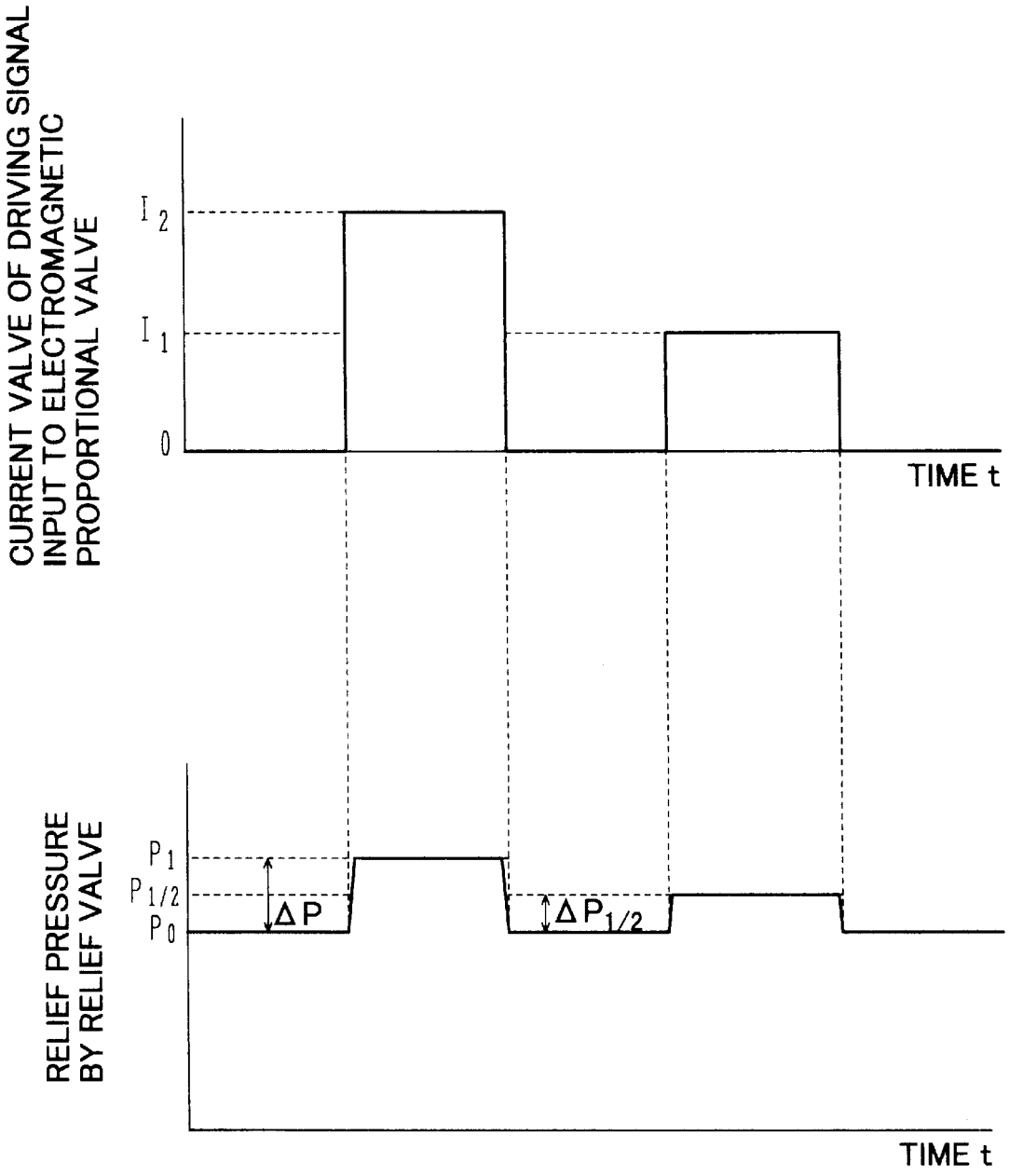
FIG. 20 is a graph showing an example of a relation between a driving signal input to the solenoid proportional valve shown in FIG. 17 and a relief pressure set by a relief valve.

FIG. 20 shows a example of a relation between a driving signal input to the solenoid proportional valve 731 and a relief pressure set by the relief valve 10. That is, when a driving signal with a current value $I_2$ is input to the solenoid proportional valve 731, the line 85 connects with the hydraulic source 32, a hydraulic fluid is delivered to the back pressure chamber of the relief valve 10 from the hydraulic source 32, the predetermined pressure $\Delta P$ is applied to the back pressure chamber, and the relief pressure is increased by the pressure $\Delta P$ and the force of the spring 10A as shown in FIG. 20 and set to P1. Moreover, when a driving signal with a current value $I_1$ is input to the solenoid proportional valve 731, the predetermined pressure $\Delta P_{1/2}$ ($<\Delta P$) is applied to the back pressure chamber of the relief valve 10 like above described, the relief pressure is increased by the pressure $\Delta P_{1/2}$ and the force of the spring 10A as shown in FIG. 20 and set to $P_{1/2}$. Furthermore, when a driving signal with a current value 0 is input to the solenoid proportional valve 731, the solenoid proportional valve 731 is switched to the disconnecting position and the hydraulic fluid in the line 85 is led to a reservoir and the relief pressure is returned to $P_0$ set by the force of the spring 10A.

FIG. 21 shows the corresponding relation between the combination of input amounts of the control lever systems 708A and 709A, operation mode selection, and signals of a rotary switch and an execution or an interruption of automatic pressure increase and pressure increase value.

Structures and functions other than the above mentioned are almost the same as those of the first embodiment.

In the above description, the controller 720 constitutes switching control means for outputting a driving signal for switching the solenoid proportional valve 731 to the disconnecting position when the input amount of operation means is less than a predetermined threshold and outputting a driving signal for switching the solenoid proportional valve 731 to the connecting position when the input amount is equal to or more than the predetermined threshold. Moreover, the controller 720 and the solenoid proportional valve 731 constitute change switching means for switching whether to perform increase or decrease of the relief pressure or not in accordance with the input amount of the operation means. Furthermore, the hydraulic source 32 and the line 85 constitute relief pressure change means for increasing or decreasing the relief pressure set by the relief valve 10, together with the above means. Furthermore, the combination switch 728 constitutes switching selection means making it possible to selectively manually input whether to execute or interrupt a switching operation by the change switching means.

The hydraulic drive system of this embodiment constituted as described above makes it possible to obtain the same advantage as that of the third embodiment. That is, by turning off the ON-OFF switch 726, the same advantage as that of the third embodiment can be obtained that automatic pressure increase corresponding to an input amount is executed only when heavy excavation or excavation is performed and automatic pressure increase is interrupted when fine operation is performed. Moreover, by manually setting the ON-OFF switch 726 to the ON(1) position (for excavation) or ON(2) position (for heavy excavation), it is possible to constantly perform the automatic increase of a relief pressure similarly to the case of the second embodiment.

Furthermore, it is possible to adjust a pressure increase value in two steps. That is, when the excavation mode is selected and an input amount increases, it is possible to obtain a pressure increase value $\Delta P_{1/2}$ which is smaller than the pressure increase value $\Delta P$ when the heavy excavation mode is selected and the input amount increases. Thereby, it is possible to correspond to the case in which the power for heavy excavation is not necessary though power is insufficient for the normal relief pressure at the time of excavation but a pressure increase value is too large to give bad influences to the service life of a cylinder if the heavy excavation mode is selected. That is, it is possible to increase power by a necessary minimum value while preventing bad influences on the service life of a cylinder.

In the above seventh embodiment, three operation modes such as the heavy excavation mode, excavation mode, and fine operation mode are selected by the three-position-type switch 328 to increase a relief pressure in the heavy excavation mode and excavation mode. However, it is also possible to use a switch capable of selecting four modes or more and thereby, perform various types of automatic pressure increase in which pressure increase values are different from each other in three operation modes or more. That is, it is necessary to adjust a pressure increase value for automatic pressure increase in a plurality of steps by using a solenoid proportional valve capable of proportionally controlling a switching value. Therefore, because a necessary minimum pressure increase value corresponding to an operation purpose can be obtained by more finely adjusting a pressure increase value, it is possible to prevent an excessive load from being applied to the cylinders 2 and 3. Therefore, it is possible to improve the service life of equipment.

The eighth embodiment of the present invention is described below by referring to FIGS. 22 and 23. This embodiment uses a hydraulic switching valve to be switched by the maximum pilot pressure of control lever systems as a valve for increasing or decreasing a relief pressure. Members which are the same as those used for the first to seventh embodiments are provided with the same symbols and their descriptions are omitted.

Figure 22:
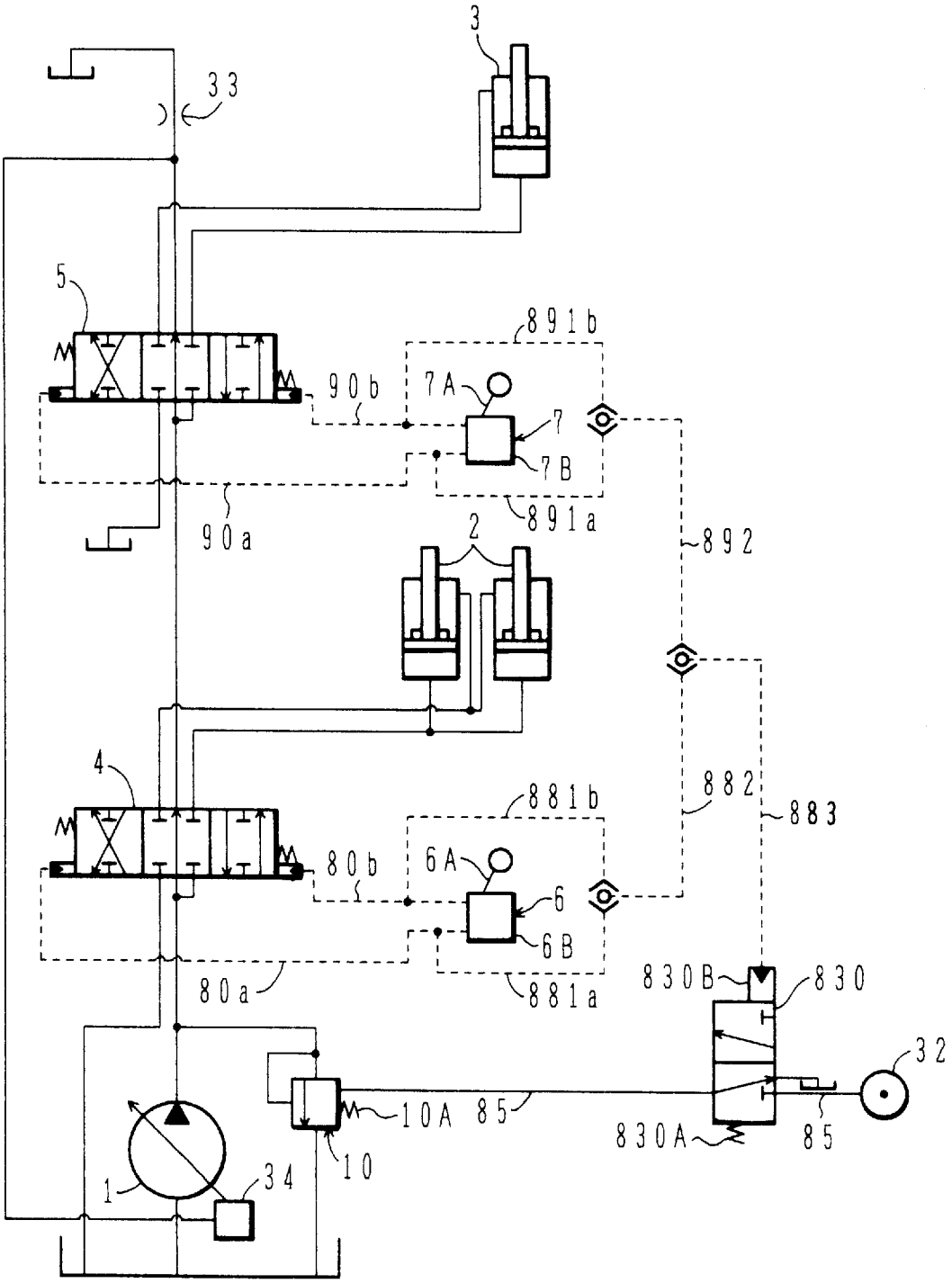
FIG. 22 is a hydraulic circuit diagram of the hydraulic drive system according to the eighth embodiment of the present invention.

FIG. 22 is a hydraulic circuit diagram of the hydraulic drive system according to this embodiment. The hydraulic drive system of this embodiment is different from the hydraulic drive system according to the first embodiment shown in FIG. 1 particularly in that a hydraulic switching valve 830 is used instead of the solenoid switching valve 30, the maximum pressure in the pilot lines $\mathbf{80}_a$, $\mathbf{80}_b$, $\mathbf{90}_a$, and $\mathbf{90}_b$ is led to a driving section 830B of the valve 830 through lines $\mathbf{881}_a$, $\mathbf{881}_b$, $\mathbf{891}_a$, $\mathbf{891}_b$, 882, 892, and 883 to switch the switching valve 830.

The switching valve 830 is pressed in the disconnecting direction of the line 85 by the force of a spring 830A. When the disconnecting-directional pressure in the line 85 to be led to the driving section 830B comes to a threshold $P_x$, the valve 830 is switched to the connecting position. In this case, the threshold $P_x$ is set so as to almost correspond to the boundary value between an input amount when performing a light operation requiring no large power such as grading and an input amount when performing a heavy operation requiring particularly large power such as load lifting or heavy excavation, like $P_{a0}$ and $P_{b0}$ described in the first to seventh embodiments.

Figure 23:
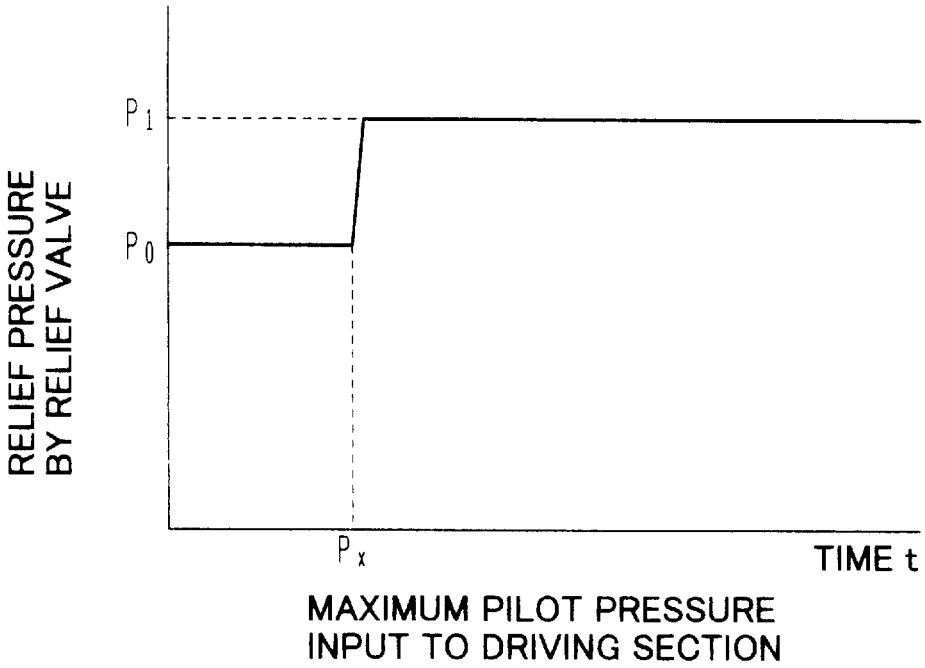
FIG. 23 is a graph showing an example of the relation between a maximum pilot pressure input to a driving section of a switching valve and a relief pressure set by a relief valve.

FIG. 23 shows an example of the relation between a maximum pilot pressure input to the driving section 830B of the switching valve 830 and a relief pressure set by the relief valve 10, which is a result of the above control. In this case, the relief pressure of the relief valve 10 by the spring 10A is set to $P_0$.

That is, when the maximum pilot pressure input to the driving section 830B is less than $P_x$, the force of the spring 830A of the switching valve 830 is larger than the force working on the driving section 830B and therefore, the switching valve 830 is switched to the disconnecting position. Thereby, the hydraulic fluid in the line 85 is led to a reservoir and the relief pressure is kept at $P_0$ set by the force of the spring 10A. On the other hand, when the maximum pilot pressure led to the driving section 830B becomes $P_x$ or more, the force working on the driving section 830B becomes larger than the force of the spring 830A and therefore, the switching valve 830 is switched to the connecting position. Thereby, the hydraulic source 32 connects with the line 85, the hydraulic fluid is delivered from the hydraulic source 32 to the back pressure chamber of the relief valve 10, the predetermined pressure $\Delta P$ is applied to the back pressure chamber, and the relief pressure is increased by the pressure $\Delta P$ and the force of the spring 10A as shown in FIG. 23 and set to $P_1$.

Structures and functions other than the above mentioned are almost the same as those of the first embodiment.

In the above description, the switching valve 830 constitutes change switching means for switching whether to perform increase or decrease of the relief pressure or not in accordance with the input amount of operation means and the hydraulic source 32 and the line 85 constitute relief pressure change means for increasing or decreasing the relief pressure set by the relief valve 10, together with the above means.

In the hydraulic drive system of this embodiment constituted as described above, when an operator operates the control lever 7A in order to operate, for example, the arm of a hydraulic excavator, a spool of the arm flow control valve 5 is removed correspondingly to the operation of the lever 7A, thereby the hydraulic fluid delivered from the hydraulic pump 1 is led to the arm cylinder 3 to drive the arm cylinder 3, and arm dumping or arm crowding is performed. Moreover, the boom is raised or lowered similarly.

When the operation performed by the operator is a light operation requiring no large power such as grading, the input amounts of the control levers 6A and 7A for operating the boom or arm becomes small. In this case, the maximum pressure in the pilot lines $\mathbf{80}_a$, $\mathbf{80}_b$, $\mathbf{90}_a$, and $\mathbf{90}_b$ led to the driving section 830B of the switching valve 830 through the lines $\mathbf{881}_a$, $\mathbf{881}_b$, $\mathbf{891}_a$, $\mathbf{891}_b$, 882, 892, and 883 becomes less than the threshold $P_x$. As a result, the switching valve 830 is kept at the disconnecting position, and the relief pressure of the relief valve 10 is not increased but it is set to the normal pressure $P_0$ set by the force of the spring 10A. Thereby, it is possible to improve the service life of equipment by preventing an excessive load from being applied to the boom cylinder 2 and arm cylinder 3 when a cylinder load pressure increases, that is, when the cylinders 2 and 3 reach their stroke end and so forth.

On the other hand, when the operation performed by the operator is a heavy operation requiring a particularly large power such as load lifting or heavy excavation, the input amounts of the control levers 6A and 7A for operating the boom or arm become large and the maximum pressure in the pilot lines $\mathbf{80}_a$, $\mathbf{80}_b$, $\mathbf{90}_a$, and $\mathbf{90}_b$ led to the driving section 830B in this case reaches the threshold $P_x$ or more. As a result, because the switching valve 830 is switched to the connecting position, the hydraulic fluid supplied from the hydraulic source 32 is led to the back pressure chamber of the relief valve 10 through the line 85 and the relief pressure of the relief valve 10 is increased from $P_0$ to $P_1$. Thereby, it is possible to operate the cylinders 2 and 3 and obtain a large power even for a large load pressure.

As described above, this embodiment also disuses the conventional switch operation for increasing or decreasing a relief pressure similarly to the case of the first embodiment and makes it possible to improve the operability for an operator.

For the above first to eighth embodiments, a case is described in which a relief pressure is automatically increased in accordance with the input amount of a control lever. However, it is also possible to automatically reduce the relief pressure in accordance with the input amount of the control lever by changing, for example, the tables in the driving-signal generating sections 160 and 161. Also in this case, an advantage is obtained that the operability is improved.

Moreover, for the first to eighth embodiments, a case is described in which the arm and boom and the arm cylinder and boom cylinder of a hydraulic excavator are used as working machines and actuators. However, it is also possible to apply the present invention to other actuators of a hydraulic excavator and hydraulic actuators of other construction machines when a relief pressure must be increased because a high pressure is required to operate the actuators and the same advantage can be obtained.

The present invention makes it possible to improve the operability for an operator because a relief pressure is automatically increased or decreased in accordance with the input amount of operation means and thereby, the conventional switch operation for increasing or decreasing the relief pressure is unnecessary.

What is claimed is:

1. A hydraulic drive system for a construction machine comprising a hydraulic pump driven by a prime mover, actuators driven by a hydraulic fluid delivered from said hydraulic pump, flow control valves for controlling flow of the hydraulic fluid supplied from said hydraulic pump to said actuators, operation means for operating said flow control valves, a relief valve for setting a relief pressure for limiting the maximum delivery pressure of said hydraulic pump, and relief pressure change means for increasing or decreasing said relief pressure set by the relief valve; wherein said relief pressure change means automatically increases or decreases said relief pressure in accordance with the input amount of said operation means.

2. A hydraulic drive system for a construction machine according to claim 1, wherein said relief pressure change means includes change switching means for switching whether to perform increase or decrease of said relief pressure or not in accordance with an input amount of said operation means.

3. A hydraulic drive system for a construction machine according to claim 2, wherein said change switching means has a solenoid valve located at a line for leading hydraulic fluid supplied from a hydraulic source to a back pressure chamber of said relief valve for connecting or disconnecting said line and switching control means for outputting a driving signal for switching said solenoid valve to a disconnecting position when said input amount of said operation means is less than a predetermined threshold and outputting a driving signal for switching said solenoid valve to a connecting position when said input amount is equal to or more than said predetermined threshold.

4. A hydraulic drive system for a construction machine according to claim 3, wherein said solenoid valve included in said change switching means comprises a solenoid proportional valve in which a spool is displaced proportionally to a driving signal input and said switching control means changes said driving signal for said solenoid proportional valve in a plurality of steps to change a position of said spool in a plurality of steps in a region in which said input amount of said operation means is equal to or more than said predetermined threshold.

5. A hydraulic drive system for a construction machine according to claim 2, wherein said flow control valve includes a pilot-operation-type valve driven by a pilot pressure, and said change switching means includes a hydraulic switching valve located at a line for leading a hydraulic fluid supplied from a hydraulic source to a back pressure chamber of said relief valve, provided with a driving section working in the direction of connecting said line when the maximum value of said pilot pressure is led to the section and a spring whose force works in the direction of disconnecting said line, and for connecting or disconnecting said line in accordance with the balance between a force due to said maximum pilot pressure and said force of said spring.

6. A hydraulic drive system for a construction machine according to claim 1, further comprising instruction means making it possible to manually input an instruction to said relief pressure change means so as to increase said relief pressure independently of said input amount of said operation means.

7. A hydraulic drive system for a construction machine according to claim 6, wherein said instruction means includes an ON-OFF switch provided with an ON position and an OFF position.

8. A hydraulic drive system for a construction machine according to claim 7, wherein said instruction means includes a rotary switch.

9. A hydraulic drive system for a construction machine according to claim 7, wherein said instruction means includes a seesaw-type two-position changeover switch.

10. A hydraulic drive system for a construction machine according to claim 2, further comprising switching selection means making it possible to selectively manually input whether to execute or interrupt a switching operation by said change switching means.

11. A hydraulic drive system for a construction machine according to claim 10, further comprising mode selection means for making it possible to manually selectively input an excavation mode wherein a selection by said mode selection means is interlocked with a selection by said switching selection means.

12. A hydraulic drive system for a construction machine according to claim 11, wherein said mode selection means includes a rotary switch.

13. A hydraulic drive system for a construction machine according to claim 11, wherein said mode selection means includes a combination of a plurality of ON-OFF switches provided with an ON position and an OFF position.

14. A hydraulic drive system for a construction machine according to claim 10, wherein said switching selection means includes a seesaw-type two-position changeover switch provided with an ON position and an OFF position.

15. A hydraulic drive system for a construction machine according to claim 1, further comprising input-amount detection means for detecting an input amount of said operation means wherein said flow control valve includes a pilot-operation-type valve driven by a pilot pressure, said operation means includes a control lever and a pressure reducing valve for reducing a pressure of hydraulic fluid supplied from a hydraulic source and producing a pilot pressure corresponding to an operation position of said control lever, and said input-amount detection means includes a pressure sensor for detecting said pilot pressure produced by said pressure reducing valve.

16. A hydraulic drive system for a construction machine according to claim 1, wherein said flow control valve includes a pilot-operation-type valve driven by a pilot pressure and said operation means includes an electric control lever and a potentiometer for outputting a signal corresponding to the operating position of said electric control lever.

17. A hydraulic drive system for a construction machine according to claim 1, further comprising input-amount detection means for detecting an input amount of said operation means wherein said input-amount detection means includes a stroke sensor for detecting a stroke of a spool provided with said flow control valve.

* * * * *